US010520843B2

(12) United States Patent
Yamashita et al.

(10) Patent No.: US 10,520,843 B2
(45) Date of Patent: Dec. 31, 2019

(54) TONER, METHOD FOR PRODUCING TONER, TONER STORAGE UNIT, AND IMAGE FORMING APPARATUS

(71) Applicants: Hiroshi Yamashita, Shizuoka (JP); Suzuka Karato, Shizuoka (JP); Yuka Mizoguchi, Shizuoka (JP); Shizuka Hashida, Saitama (JP)

(72) Inventors: Hiroshi Yamashita, Shizuoka (JP); Suzuka Karato, Shizuoka (JP); Yuka Mizoguchi, Shizuoka (JP); Shizuka Hashida, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/919,256

(22) Filed: Mar. 13, 2018

(65) Prior Publication Data

US 2018/0267420 A1 Sep. 20, 2018

(30) Foreign Application Priority Data

Mar. 16, 2017 (JP) ..... 2017-050858

(51) Int. Cl.
*G03G 9/09* (2006.01)
*G03G 15/08* (2006.01)
(Continued)

(52) U.S. Cl.
CPC ..... *G03G 9/0926* (2013.01); *G03G 9/0804* (2013.01); *G03G 9/087* (2013.01);
(Continued)

(58) Field of Classification Search
CPC .... G03G 9/0926; G03G 9/0825; G03G 9/087; G03G 15/08; G03G 9/08755; G03G 9/0827; G03G 9/08795; G03G 9/0804; G03G 9/08797; G03G 9/08782; G03G 9/08764; G03G 9/0819; G03G 2215/0872
See application file for complete search history.

(56) References Cited

U.S. PATENT DOCUMENTS

2008/0318144 A1 12/2008 Watanabe et al.
2011/0033203 A1 2/2011 Watanabe et al.
(Continued)

FOREIGN PATENT DOCUMENTS

JP 2012-032765 2/2012
JP 2012-208142 10/2012
(Continued)

OTHER PUBLICATIONS

Extended European Search Report dated Jun. 22, 2018 in European Patent Application No. 18161366.2 citing documents AA-AC therein, 7 pages.

*Primary Examiner* — Thorl Chea
(74) *Attorney, Agent, or Firm* — Oblon, McClelland, Maier & Neustadt, L.L.P.

(57) ABSTRACT

A toner is provided. The toner includes toner particles each comprising a binder resin and plate-like pigment particles. In a cross-section of the toner, the plate-like pigment particles have an average thickness D of 1.0 μm or less and a maximum length L of 5.0 μm or more. In a fixed toner image formed with the toner, the plate-like pigment particles have a maximum width W of 3.0 μm or more. The toner has a circularity of from 0.950 to 0.985.

7 Claims, 7 Drawing Sheets

(51) Int. Cl.
*G03G 9/087* (2006.01)
*G03G 9/08* (2006.01)

(52) U.S. Cl.
CPC ..... *G03G 9/0825* (2013.01); *G03G 15/08* (2013.01); *G03G 2215/0872* (2013.01)

(56) References Cited

U.S. PATENT DOCUMENTS

| | | | | |
|---|---|---|---|---|
| 2012/0237868 | A1 | 9/2012 | Yamada et al. | |
| 2014/0045113 | A1 | 2/2014 | Takahashi et al. | |
| 2015/0248081 | A1* | 9/2015 | Kuribayashi ..... | G03G 15/657 399/68 |
| 2015/0268570 | A1 | 9/2015 | Sakai et al. | |
| 2015/0277252 | A1 | 10/2015 | Takahashi et al. | |
| 2017/0199476 | A1 | 7/2017 | Santoh et al. | |

FOREIGN PATENT DOCUMENTS

| | | |
|---|---|---|
| JP | 2016-139053 | 8/2016 |
| JP | 2016-139062 | 8/2016 |

* cited by examiner

CIRCUMFERENTIAL LENGTH: C1
PROJECTED AREA: S

CIRCLE HAVING AREA S
CIRCUMFERENTIAL LENGTH: C2

TONER, METHOD FOR PRODUCING TONER, TONER STORAGE UNIT, AND IMAGE FORMING APPARATUS

CROSS-REFERENCE TO RELATED APPLICATIONS

This patent application is based on and claims priority pursuant to 35 U.S.C. § 119(a) to Japanese Patent Application No. 2017-050858, filed on Mar. 16, 2017 in the Japan Patent Office, the entire disclosure of which is hereby incorporated by reference herein.

BACKGROUND

Technical Field

The present disclosure relates to a toner, a method for producing toner, a toner storage unit, and an image forming apparatus.

Description of the Related Art

As electrophotographic color image forming apparatuses have been widely spread, their applications have been diversified. There is a demand for metallic-tone image in addition to conventional color image.

What is called a glittering toner that contains a metallic pigment in a binder resin has been used to form an image having glittering texture like metal.

Such an image with metallic luster exhibits strong light reflectivity when viewed from a certain angle. To achieve this, a highly-reflective pigment ("glittering pigment") having a scale-like plane is generally blended in the glittering toner.

Suitable examples of the highly-reflective pigment include metals and metal-coated pigments. For securing reliable reflectivity, each pigment particle has a plane with a certain degree of area so that pigment particles are arranged in a planer form in a fixed toner image.

SUMMARY

In accordance with some embodiments of the present invention, a toner is provided. The toner includes toner particles each comprising a binder resin and plate-like pigment particles. In a cross-section of the toner, the plate-like pigment particles have an average thickness D of 1.0 μm or less and a maximum length L of 5.0 μm or more. In a fixed toner image formed with the toner, the plate-like pigment particles have a maximum width W of 3.0 μm or more. The toner has a circularity of from 0.950 to 0.985.

In accordance with some embodiments of the present invention, a method for producing toner is provided. The method includes the step of dispersing an organic liquid in an aqueous medium to prepare an oil-in-water emulsion, where the organic liquid contains plate-like pigment particles and a substance capable of being in at least one of a needle-like state or a plate-like state.

In accordance with some embodiments of the present invention, a toner storage unit is provided. The toner storage unit includes a container and the above-described toner contained in the container.

In accordance with some embodiments of the present invention, an image forming apparatus is provided. The image forming apparatus includes an electrostatic latent image bearer, an electrostatic latent image forming device, a developing device, a transfer device, and a fixing device. The electrostatic latent image forming device is configured to form an electrostatic latent image on the electrostatic latent image bearer. The developing device contains the above-described toner and is configured to develop the electrostatic latent image on the electrostatic latent image bearer into a toner image with the toner. The transfer device is configured to transfer the toner image from the electrostatic latent image bearer onto a surface of a recording medium. The fixing device is configured to fix the toner image on the surface of the recording medium.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1A:
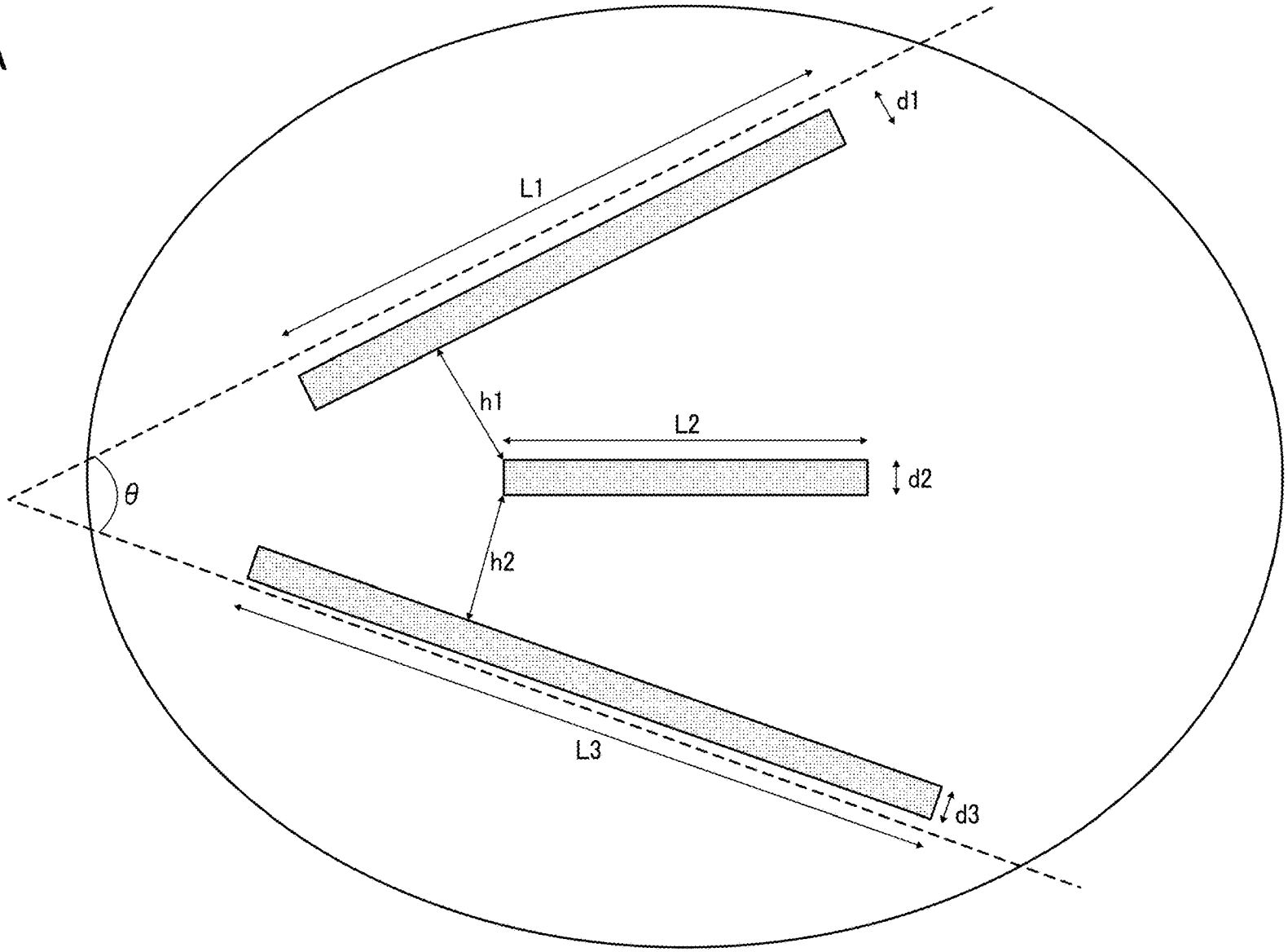
FIG. 1A is an illustration of a cross-sectional image of a toner in accordance with some embodiments of the present invention, observed by a field emission scanning electron microscope (FE-SEM)

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

In accordance with some embodiments of the present invention, a toner is provided that is capable of forming a high-definition high-quality image with glittering property and of preventing the occurrence of electrical resistivity decrease and dielectric constant increase to prevent deterioration of electrical and charge properties.

Conventionally, it has been considered that a glittering toner image is achieved when the planes of the glittering pigment particles are aligned at the surface of the image and light is effectively reflected by the planes. Thus, it has been believed that plate-like pigment particles are preferably oriented in one direction inside the toner.

In the toner disclosed in JP-5365648-B (corresponding to JP-2012-32765-A) or JP-2016-139053-A, the average particle diameter of the toner is adjusted to be greater than the thickness of the toner. When multiple pigment particles in a flat shape are dispersed orienting in one direction in such a thin toner particle, the flat pigment particles are stacked on each other with a narrow gap therebetween.

When glittering pigment particles are dispersed in a toner in a stacking manner with a narrow gap therebetween, electrical resistivity of the toner will deteriorate that leads to easy formation of electrical conduction path. This is because most glittering pigment particles are made of or coated with a metal. In this case, specific dielectric constant of the toner increases and charge retention property at the surface of the toner decreases, resulting in deterioration of chargeability of the toner.

Toner particles in a thin shape have poor powder fluidity, and exhibit poor uniformly-mixing property at the time of toner supply or in a developer. When the thickness of toner particles is small, pigment particles are easily exposed at the surface of the toner particles when the developer thereof is stirred or rubbed with a developing sleeve or a blade-like member, that leads to deterioration of electrical property and chargeability of the toner.

Moreover, toner particles having a flat shape have poor cleanability. Thus, such toner particles having a flat shape will damage a photoconductor or transfer member when being removed from the surface thereof, possibly causing flaw or fouling. Such toner particles having a flat shape also have difficulty in forming a high-definition high-quality image.

A toner capable of forming a high-definition high-quality image with glittering property and of preventing the occurrence of electrical resistivity decrease and dielectric constant increase to prevent deterioration of electrical and charge properties has not been provided so far.

The inventors of the present invention have studied in view of the above situation and achieved a method for manufacturing a toner having a nearly spherical shape in which glittering pigment particles in a flat shape are dispersed in a desired state without becoming too thick. The toner manufactured by this method has a high circularity and plate-like pigment particles are dispersed therein in a desired state satisfying average thickness, maximum length, and maximum width.

This toner not only secures glittering property of the resulting image but also prevents electrical resistivity decrease or dielectric constant increase of the toner that may be caused by uneven distribution of low-electrical-resistivity substance. This is because glittering pigment particles are distributed in the toner at a certain distance. This method prevents the resulting toner from being in a flat shape. Thus, the toner is prevented from lowering fluidity. The toner is also prevented from degrading electric property and chargeability, which may be caused when glittering pigment particles are exposed upon application of stress. This toner is capable of forming high-definition high-quality images due to its shape that provides excellent developability and transferability.

Accordingly, the toner in accordance with some embodiments of the present invention is capable of forming a high-definition high-quality image with glittering property and of preventing the occurrence of electrical resistivity decrease and dielectric constant increase to prevent deterioration of electrical and charge properties.

Toner

The toner in accordance with some embodiments of the present invention comprises toner particles each comprising at least a resin and plate-like pigment particles. The toner may further comprise a wax or crystalline resin that is capable of being in a needle-like or plate-like state.

Circularity of Toner

The toner in accordance with some embodiments of the present invention has a circularity of from 0.950 to 0.985.

When the toner has a high level of circularity, in other words, the toner has a spherical shape, plate-like pigment particles can be distributed within the toner at a certain distance. As a result, the plate-like pigment particles are prevented from coming close to each other or coming into contact with each other, thereby preventing deterioration of electrical property and chargeability of the toner. In addition, such a toner having a high circularity is well removable from a photoconductor or transfer belt without damaging it while well maintaining transferability.

When the circularity is less than 0.950, transferability of the toner is too poor to reproduce high-definition image. Moreover, a photoconductor or transfer belt may be easily damaged when the toner is removed therefrom.

When the circularity is greater than 0.985, cleanability of the toner is poor, i.e., the toner is poorly removable with a blade, and a line-like abnormal image is generated.

Figure 4A:
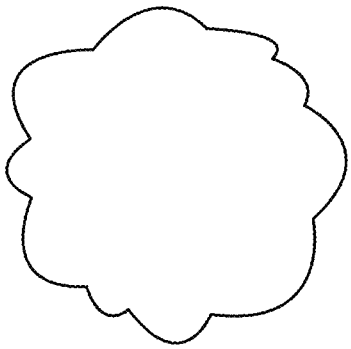
FIGS. 4A and 4B are illustrations for explaining a procedure for measuring circularity of toner particle.
Figure 4B:
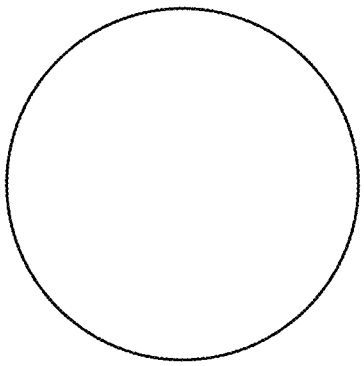

Here, the "circularity" refers to an average circularity measured by a flow particle image analyzer FPIA-2000 (product of Toa Medical Electronics Co., Ltd.) in the following manner. First, 0.1 to 0.5 mL of a surfactant, preferably an alkylbenzene sulfonate, serving as a dispersant, is added to 100 to 150 mL of water from which solid impurities have been removed, and further 0.1 to 0.5 g of a sample (toner) is added thereto. The resulting suspension liquid in which the toner is dispersed is subjected to a dispersion treatment by an ultrasonic disperser for about 1 to 3 minutes. The resulting dispersion liquid containing 3,000 to 10,000 toner particles/μL is set to the above-described analyzer and subjected to a measurement of toner shape and distribution. The circularity of a toner particle is determined from a ratio C2/C1, where C1 represents an outer circumferential length of a projected image of the toner particle having a projected area S, as illustrated in FIG. 4A, and C2 represents an outer circumferential length of a true circle having the same area as the projected area S of the toner particle, as illustrated in FIG. 4B. Based on the measurement results, the average circularity is determined as the "circularity" of the toner.

Plate-Like Pigment

The pigment particles in the toner in accordance with some embodiments of the present invention have a plate-like shape. The plate-like pigment particles are distributed within the toner so as to have desired average thickness, maximum length, and maximum width, when observed in the below-described manner.

Preferably, the pigment is a metallic pigment. Specific examples of the metallic pigment include, but are not limited to: powders of metals such as aluminum, brass, bronze, nickel, stainless steel, zinc, copper, silver, gold, and platinum; and metal-deposited flake-like glass powder. Preferably, the plate-like pigment particles are surface-treated for improving dispersibility and contamination resistance. The plate-like pigment particles may be coated with a surface treatment agent, silane coupling agent, titanate coupling agent, fatty acid, silica particle, acrylic resin, or polyester resin.

Preferably, the plate-like pigment particles are in a scale-like (plate-like) or flat shape to provide a light reflective surface. Glittering property is exhibited by such a configuration. One particle of the pigment is in a thin-plate-like shape, so as to provide a plane surface having a certain degree of area with a small volume.

One type of plate-like pigment may be used or two or more types of plate-like pigments may be used in combination. For adjusting color, the plate-like pigment may be used in combination with other colorants such as dyes and pigments.

Preferably, the content rate of the plate-like pigment in the toner is from 5% to 50% by mass.

In a cross-section of the toner, the plate-like pigment particles have an average thickness D of 1.0 μm or less and a maximum length L of 5.0 μm or more. In a fixed toner image formed with the toner, the plate-like pigment particles have a maximum width W of 3.0 μm or more.

The toner has desired glittering property due to the presence of the plate-like pigment particles having a certain degree of area.

Average Thickness D

The average thickness D of the plate-like pigment particles is determined as follows.

A cross-section of the toner is observed by a scanning electron microscope (FE-SEM). The average thickness D is measured from a SEM image of the toner.

FIG. 1A is a conceptional image of a toner particle containing plate-like pigment particles.

Figure 1B:
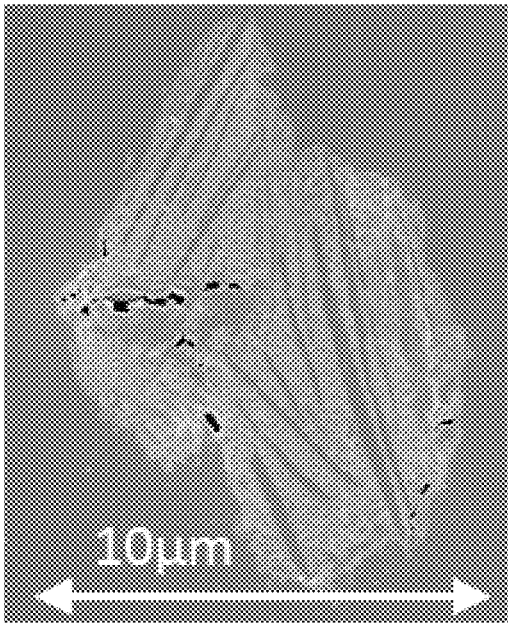
FIG. 1B is a cross-sectional image of a toner in accordance with some embodiments of the present invention, observed by FE-SEM.

FIG. 1B is an actual SEM image of a toner particle containing plate-like pigment particles.

In a cross-section of one toner particle containing plate-like pigment particles illustrated in FIG. 1A, the average value d among the thicknesses d1, d2, and d3 of the plate-like pigment particles is determined. The average value d is determined for other toner particles in the same manner. Specifically, the average value d is determined for 20 toner particles in total, and the average of the 20 average values d is calculated as the average thickness D.

The average thickness D of the plate-like pigment particles is 1.0 μm or less.

When the average thickness D is greater than 1.0 μm, metallic particles easily contact with each other, thus easily lowering electrical resistivity of the toner. In addition, the blending ratio of the plate-like pigment particles becomes so high that toner is inhibited from being fixed.

Preferably, the average thickness D is in the range of from 0.5 to 1.0 μm. When the average thickness D is 0.3 μm or less, the toner may transmit light and lose glittering property.

Maximum Length L

The maximum length L of the plate-like pigment particles is determined as follows.

In a cross-section of one toner particle containing plate-like pigment particles illustrated in FIG. 1A, one of the plate-like pigment particles having the longest length 1 is determined. The longest length 1 thus determined is represented by L3 in FIG. 1A. The longest length 1 is determined for other toner particles in the same manner. Specifically, the longest length 1 is determined for 20 toner particles in total, and the average of the 20 longest lengths 1 is calculated as the maximum length L.

The maximum length L of the plate-like pigment particles is 5.0 μm or more.

When the maximum length L is less than 5.0 μm, diffuse reflection components increase and glittering property is lost.

Preferably, the maximum length L is in the range of from 5.0 to 20 μm. When the maximum length L is greater than 20 μm, the toner particle is not able to incorporate the plate-like pigment particles and allows them to project from the surface, causing deterioration of electrical resistivity of the toner. Moreover, the particle diameter of the toner becomes too large to achieve high-definition image.

Sample Preparation and FE-SEM Observation Conditions

Observation Procedure

1: A sample is dyed in a vaporous atmosphere of a 5% aqueous solution of $RuO_4$.

2: The dyed samples is embedded in a 30-minute-curable epoxy resin and allowed to cure between parallel TEFLON (registered trademark) plates.

3: The cured sample in an oval shape is cut with a razor at its central portion.

4: The sample is fixed to an ion milling sample holder with Ag paste so that the cut surface of the sample can be processed.

5: The cut surface is processed by an ion milling device while being cooled at −100 degrees C.

6: The processed cut surface is observed with a cold cathode field emission scanning electron microscope (cold FE-SEM).

Processing conditions and observation conditions are described below.

Ion Milling Processing Conditions

ACCELERATION V./3.8 kV (Acceleration voltage setting)

DISCHARGE V./2.0 kV (Discharge voltage setting)

DISCHARGE CURR. Display/386 μA (Discharge current)

ION BEAM CURR. Display/126 μA (Beam current)

Stage Control/C4 Swing Angle±30° Speed/Reciprocating 30 times/min

Ar GAS FLOW/0.08 cm/min

Cooling Temperature/−100 degrees C.

Setting Time/2.5 hours

SEM Observation Conditions Accelerating Voltage: 1.0 kV, WD: 3.8 mm, ×3K, ×3.5K

SEM Image: SE(U), Reflection Electron Image: HA(T)

Instruments

Observation: Cold cathode field emission scanning electron microscope (cold FE-SEM) SU8230, product of Hitachi High-Technologies Corporation Processing: Ion milling device IM4000, product of Hitachi High-Technologies Corporation Maximum Width W The maximum width W of the plate-like pigment particles is determined as follows.

A fixed toner image is formed with the toner while adjusting the toner deposition amount to a low amount of from 0.1 to 0.3 mg/cm$^2$ so that toner particles do not overlap each other as much as possible. In the fixed toner image, the toner particles have been melted and only plate-like pigment particles are observable. The fixed toner image is observed with an optical microscope at a magnification of from 200 to 500 times and a reflection image is photographed. Plate-like pigment particles which are independent from each other without being overlapped with another particle are selected from the photograph. (In a case in which small plate-like pigment particles are overlapped above them, the field of view is appropriately adjusted.)

Figure 2:
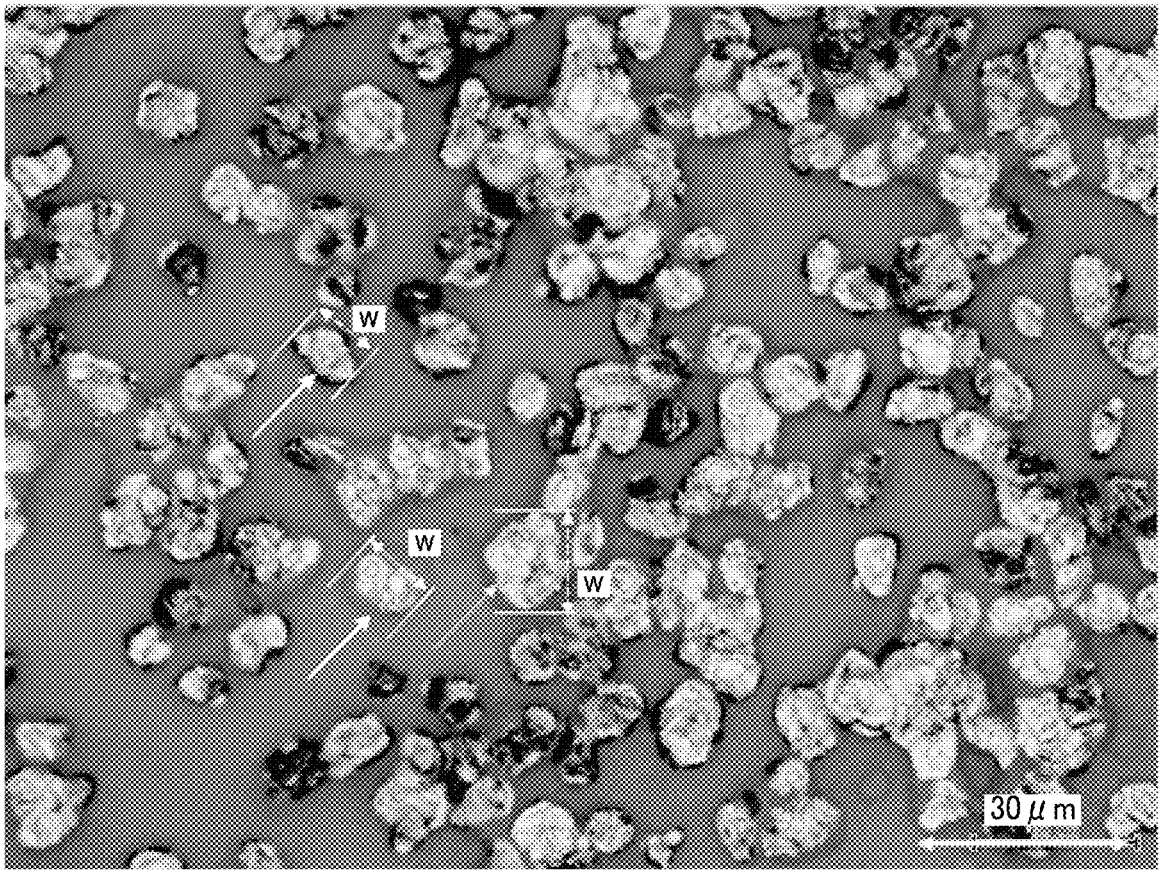
FIG. 2 is an image of a toner in accordance with some embodiments of the present invention, observed by an optical microscope.

FIG. 2 is an actual microscopic image of a fixed toner image.

In a fixed toner image illustrated in FIG. 2, 20 plate-like pigment particles which are not overlapped with another particle, indicated by arrows, are selected. The largest diameter w is determined for each of the selected plate-like pigment particles. The average of the 20 largest diameters w determined for the 20 selected plate-like pigment particles is calculated as the maximum width W.

The maximum width W is 3.0 μm or more.

When the maximum width W is less than 3.0 μm, the light reflective area is small, diffuse reflection components increase, and glittering property is lost.

Preferably, the maximum width W is in the range of from 3.0 to 10 μm. When the maximum width W is greater than 10 μm, the toner particle is not able to incorporate the plate-like pigment particles and allows them to project from the surface, causing deterioration of electrical resistivity of the toner. Moreover, the particle diameter of the toner becomes too large to reproduce high-definition image.

Preferably, the plate-like pigment particles further meet the following requirements.

Average Distance H

In a cross-section of one toner particle containing plate-like pigment particles illustrated in FIG. 1A, the average value h among the shortest distances h1 and h2 between adjacent plate-like pigment particles is determined. The average value h is determined for other toner particles in the same manner. Specifically, the average value h is determined for toner particles in total, and the average of the 20 average values h is calculated as the average distance H.

Preferably, the average distance H between the plate-like pigment particles is 0.5 μm or more.

In this case, the plate-like pigment particles are distributed in the toner at a certain distance, thereby preventing electrical resistivity decrease or dielectric constant increase of the toner that may be caused by uneven distribution of low-electrical-resistivity substance.

When the average distance H is 0.5 μm or more, the plate-like pigment particles are effectively prevented from coming into contact with each other, thereby preventing electrical resistivity decrease and dielectric constant increase of the toner and deterioration of transferability and chargeability of the toner.

More preferably, the average distance H between the plate-like pigment particles is in the range of from 0.5 to 3 μm. When the average distance H is 3 μm or less, a problem such that the particle diameter of the toner becomes too large to reproduce high-definition image can be effectively prevented. In addition, another problem can be also effectively prevented such that the plate-like pigment particles are unlikely to be aligned at the surface of the image at the time when the image is fixed and thereby glittering property is not exhibited.

Deviation Angle θ

In a cross-section of one toner particle containing plate-like pigment particles illustrated in FIG. 1A, one of the plate-like pigment particles having the longest length is specified. In FIG. 1A, the longest length is represented by L3. Next, another one of the plate-like pigment particles forming the largest deviation angle with the above-specified plate-like pigment particle having the longest length is specified. A deviation angle θ formed between the above-specified plate-like pigment particle having the longest length and the above-specified plate-like pigment particle forming the largest deviation angle is determined. The deviation angle θ is determined for other toner particles in the same manner. Specifically, the deviation angle θ is determined for 20 toner particles in total.

Preferably, the ratio of toner particles having a deviation angle θ of 20° or more is 30% by number or more based on all the observed toner particles.

At the time when the toner is fixed on a flat surface of paper or film, the toner melts and the plate-like pigment particles tend to align with their surface being parallel. Therefore, the plate-like pigment particles need not necessarily align in the same direction inside the toner particle. The more deviated the orientation of the plate-like pigment particles, the higher the circularity of the toner. In this case, the toner is well removable from a photoconductor or transfer belt without damaging it while well maintaining transferability.

When the ratio of toner particles having a deviation angle of 20° or more is 30% by number or more, a problem such that the plate-like pigment particles are excessively aligned to decrease electrical resistivity can be effectively prevented. Glittering property is well exhibited when the pigment particle having the largest particle diameter reflects light to express metallic luster. When toner particles having a deviation angle of 20° or more account for 30% by number of the total toner particles, glittering property is not inhibited because there is no stacked pigment particles close to each other.

To obtain a toner having a desired circularity and in which plate-like pigment particles are dispersed with desired average thickness, maximum length, and maximum width, one of the following procedures (1) to (3) is preferably conducted in the process of producing the toner.

(1) Procedure 1 for Adjusting Circularity of Toner and Distance Between Plate-Like Pigment Particles One preferred method for producing the toner includes the process of dispersing an organic liquid in an aqueous medium to prepare an oil-in-water emulsion, where the organic liquid contains the plate-like pigment and optionally a substance capable of being in at least one of a needle-like state or a plate-like state. As oil droplets are formed in the aqueous medium, the plate-like pigment particles are allowed to freely move in the oil droplets and prevented from aligned in one direction. The oil droplets thereafter become toner particles in which the plate-like pigment particles and the needle-like or plate-like substance are fixed. Thus, the toner particles are prevented from being in a flat shape. In particular, coexistence of the needle-like or plate-like substance effectively prevents the plate-like pigment particles from being aligned in one direction.

The above method for producing the toner is preferably embodied by a dissolution suspension method in which a toner binder resin, a colorant, etc., are dissolved or dispersed in an organic solvent to prepare oil droplets, or a suspension polymerization method that uses radical polymerizable monomer.

(2) Procedure 2 for Adjusting Shape of Toner

A flat shape of toner particles may be corrected by reducing the viscosity of the oil droplets in the aqueous medium while applying a shearing force thereto, in the process of producing the toner. In the process of removing solvent in a dissolution suspension method, or when the polymerization conversion is on the way in a suspension polymerization method, an ellipsoidal shape of toner particles can be corrected into a substantially spherical shape as a shearing force is applied to the dispersion liquid.

(3) Procedure 3 for Adjusting Shape of Toner

In a case in which the plate-like pigment particles are covered with a resin, it is preferable that the surface of the toner has high viscoelasticity.

Specifically, it is preferable that reactive functional groups are preferentially disposed at the surface of the toner to cause a polymeric or cross-linking reaction.

For example, it is possible to use materials capable of reacting at the interface of the oil droplet and the aqueous medium in the process of producing the toner. One of the materials is a reactive prepolymer and contained in the oil droplets. The other is a substance reactive with the prepolymer and contained in the aqueous medium.

It is also effective to dispose solid fine particles at the surface of the toner so that the surface of the toner maintains high viscoelasticity. For example, it is preferable that organically-modified inorganic fine particles that are easy to orient at the oil-water interface are contained in the oil droplets. Specific examples of the organically-modified inorganic fine particles include, but are not limited to, organically-modified bentonite, organically-modified montmorillonite, and organic-solvent-dispersible colloidal silica.

Needle-Like or Plate-Like Substance

It is effective to blend a solid substance in the toner for widening the distance between the planes of the plate-like pigment particles or disposing the plate-like pigment particles inside the toner at a certain distance from the surface of the toner. Preferably, a substance capable of being in a needle-like or plate-like state is blended in the toner for effectively widening the distance between the planes of the plate-like pigment particles. More preferably, the substance is disposed facing a direction different from that of the planes of the plate-like pigment particles.

As described above, the plate-like pigment particles are preferably disposed separated from each other inside the toner.

The substance capable of being in a needle-like or plate-like state can be disposed in the toner facing a direction different from that of the planes of the plate-like pigment particles. As a result, the toner particle can be formed into a substantially spherical shape, not a flat shape. In addition, because the needle-like or plate-like substance is disposed between the plate-like pigment particles while facing a direction different from that of the planes of the plate-like pigment particles, the distance between the planes of the plate-like pigment particles can be widened.

Among toner components, a wax serving as a release agent and a crystalline resin serving as a binder resin that supplements fixability of the toner are easy to become a needle-like or plate-like state. Therefore, preferably, the toner in accordance with some embodiments of the present invention contains a wax or crystalline resin as the substance capable of being in at least one of a needle-like state or a plate-like state.

Inside the toner, the needle-like or plate-like substance can be disposed in a gap between the plate-like pigment particles, thereby widening the distance between the planes of the plate-like pigment particles. When the needle-like or plate-like substance is a wax or crystalline resin capable of being in a needle-like or plate-like state, releasing property and low-temperature fixability are improved, which is more preferable.

Method for Preparing Needle-Like or Plate-Like Substance

A material to be used as the needle-like or plate-like substance is once dissolved in an organic solvent, cooled, and then precipitated to cause crystal growth and form a needle-like or plate-like morphology. The crystal size can be adjusted by adjusting the material concentration, precipitation speed, stirring condition, and/or cooling speed. Too large a crystal size may be adjusted to an appropriate size by using a homogenizer, high-pressure emulsifier, or bead mill.

Preferably, the average of the long diameters of the needle-like or plate-like substance particles is 10% to 100%, more preferably 20% to 50%, of the average of the long diameters of the plate-like pigment particles. It is preferable that one toner particle contains the needle-like or plate-like substance particles in an amount of 10% to 100% by number of the plate-like pigment particles. In this case, the plate-like pigment particles can be disposed in the toner at a desired distance.

Figure 3:
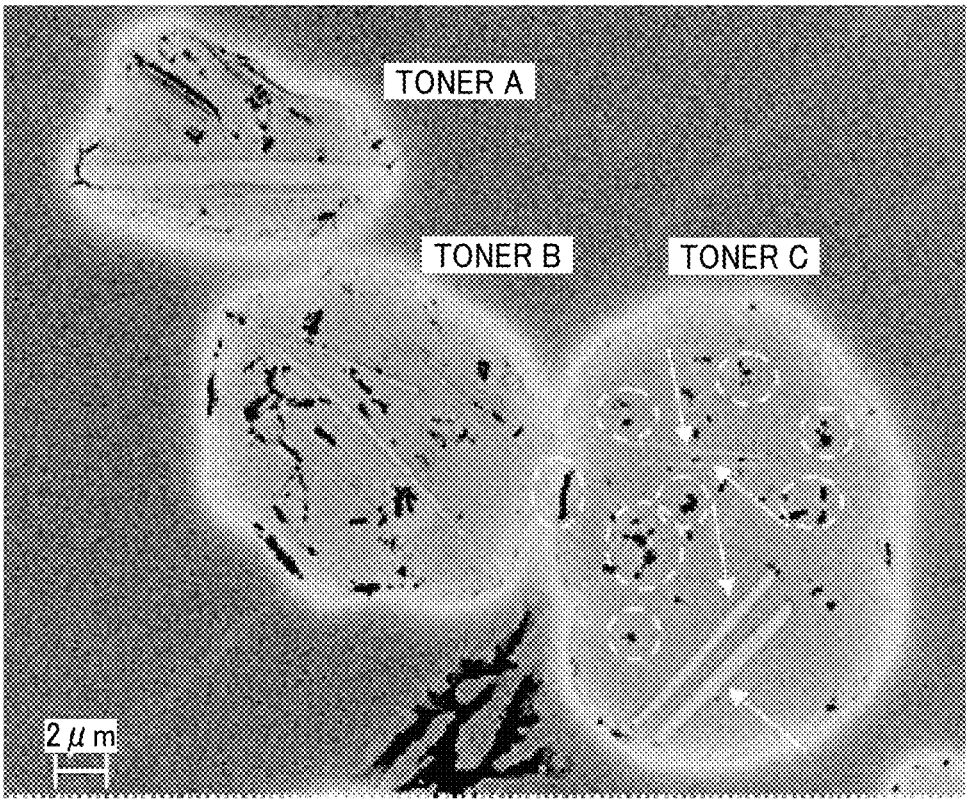
FIG. 3 is a cross-sectional image of a toner in accordance with some embodiments of the present invention, observed by FE-SEM.

FIG. 3 is a cross-sectional image of toner particles in which plate-like pigment particles and needle-like or plate-like wax particles are present together. In FIG. 3, domains indicated by arrows represent plate-like pigment particles and domains encircled by dotted lines represent needle-like or plate-like wax particles.

FIG. 3 is obtained by FE-SEM under the following conditions, and a sample for SEM observation is prepared as follows.

Sample Preparation for FE-SEM Observation

Observation Procedure

1: A sample is dyed in a vaporous atmosphere of a 5% aqueous solution of $RuO_4$.

2: The dyed samples is embedded in a 30-minute-curable epoxy resin and allowed to cure between parallel TEFLON (registered trademark) plates.

3: The cured sample in an oval shape is cut with a razor at its central portion.

4: The sample is fixed to an ion milling sample holder with Ag paste so that the cut surface of the sample can be processed.

5: The cut surface is processed by an ion milling device while being cooled at −100 degrees C.

6: The sample having the cut surface is dyed again in a vaporous atmosphere of a 5% aqueous solution of $RuO_4$.

7: The processed cut surface is observed with a cold cathode field emission scanning electron microscope (cold FE-SEM).

Other observation conditions are the same as those described in the above "Sample Preparation and FE-SEM Observation Conditions" section.

Wax

Preferably, the needle-like or plate-like substance for preventing stacking of the plate-like pigment particles or widening the distance between the planes of the plate-like pigment particles is a wax to which a branched structure or a polar group has been introduced, in its manufacturing process, so that a certain degree of polarity is imparted to the wax. The melting point of the wax may be the same level as the melting temperature of the binder resin of the toner, or may be higher than the melting temperature thereof as long as being equal to or lower than the temperature of an image being fixed on a paper sheet.

Examples of the needle-like or plate-like substance include modified waxes to which a polar group, such as hydroxyl group, carboxyl group, amide group, and amino group, has been introduced. Examples thereof further include oxidization-modified waxes prepared by oxidizing hydrocarbon by an air oxidization process and metal salts (e.g., potassium salt and sodium salt) thereof; acid-group-containing polymers (e.g., maleic anhydride copolymer and alpha-olefin copolymer) and salts thereof; and alkoxylated products of hydrocarbons modified with imide ester, quaternary amine salt, or hydroxyl group.

Examples of the wax include, but are not limited to, carbonyl-group-containing wax, polyolefin wax, and long-chain hydrocarbon wax.

Specific examples of esterification products of the carbonyl-group-containing wax include, but are not limited to, polyalkanoic acid ester, polyalkanol ester, polyalkanoic acid amide, polyalkyl amide, and dialkyl ketone.

Specific examples of the polyalkanoic acid ester wax include, but are not limited to, carnauba wax, montan wax, trimethylolpropane tribehenate, pentaerythritol tetrabehenate, pentaerythritol diacetate dibehenate, glycerin tribehenate, and 1,18-octadecanediol distearate.

Specific examples of the polyalkanol ester include, but are not limited to, tristearyl trimellitate and distearyl maleate.

Specific examples of the polyalkanoic acid amide include, but are not limited to, dibehenylamide.

Specific examples of the polyalkyl amide include, but are not limited to, trimellitic acid tristearylamide.

Specific examples of the dialkyl ketone include, but are not limited to, distearyl ketone. Among these carbonyl-group-containing waxes, polyalkanoic acid ester is preferable.

Specific examples of the polyolefin wax include, but are not limited to, polyethylene wax and propylene wax.

Specific examples of the long-chain hydrocarbon wax include, but are not limited to, paraffin wax and SASOL wax.

The wax preferably has a melting point of from 50° C. to 100° C., more preferably from 60° C. to 90° C. When the melting point is 50° C. or higher, heat-resistant storage stability of the toner can be well maintained. When the melting point is 100° C. or lower, cold offset does not occur even when the toner is fixed at a low temperature.

The melting point of the wax can be measured by a differential scanning calorimeter (TA-60WS and DSC-60 available from Shimadzu Corporation) as follows. First, about 5.0 mg of a wax is put in an aluminum sample container. The sample container is put on a holder unit and set in an electric furnace. In nitrogen atmosphere, the sample is heated from 0° C. to 150° C. at a temperature rising rate of 10° C./min, cooled from 150° C. to 0° C. at a temperature falling rate of 10° C./min, and reheated to 150° C. at a temperature rising rate of 10° C./min, thus obtaining a DSC curve. The DSC curve is analyzed with analysis program installed in DSC-60, and the temperature at the largest peak of melting heat in the second heating is determined as the melting point.

The wax preferably has a melt viscosity of from 5 to 100 mPa·sec, more preferably from 5 to 50 mPa·sec, most preferably from 5 to 20 mPa·sec, when measured at 100° C. When the melt viscosity is 5 mPa·sec or higher, deterioration of releasability can be prevented. When the melt viscosity is 100 mPa·sec or lower, deterioration of hot offset resistance and low-temperature releasability can be effectively prevented.

The total content rate of the waxes, including the wax serving as the needle-like or plate-like substance and other waxes, in the toner is preferably from 1% to 30% by mass, more preferably from 5% to 10% by mass. When the total content rate is 5% by mass or more, deterioration of hot offset resistance of the toner can be effectively prevented. When the total content rate is 10% by mass or less, deterioration of heat-resistant storage stability, chargeability, transferability, and stress resistance of the toner can be effectively prevented.

The content rate of the wax serving as the needle-like or plate-like substance to the plate-like pigment is preferably from 1% to 30% by mass, more preferably from 5% to 10% by mass.

Crystalline Resin

Specific preferred examples of the crystalline resin include, but are not limited to, polyester resin prepared from a diol component and a dicarboxylic acid component, ring-opened polymer of lactone, and polymer of polyhydroxycarboxylic acid. Specific preferred examples of the crystalline resin further include urethane-modified polyester resin, urea-modified polyester resin, polyurethane resin, and polyurea resin, each of which having urethane bond and/or urea bond. Among these, urethane-modified polyester resin and urea-modified polyester resin are preferable because they exhibit a high degree of hardness while maintaining crystallinity of the resin.

Urethane-Modified Polyester Resin

The urethane-modified polyester resin may be obtained by a reaction between a polyester resin and an isocyanate component having 2 or more valences, or a reaction between a polyester resin having a terminal isocyanate group and a polyol component.

Examples of the polyester resin include polycondensed polyester resin obtained by a polycondensation of a diol component with a dicarboxylic acid component, ring-opened polymer of lactone, and polyhydroxycarboxylic acid. Among these, polycondensed polyester resin obtained by a polycondensation of a diol component with a dicarboxylic acid component is preferable for exhibiting crystallinity.

Diol Component

Preferred examples of the diol component include aliphatic diols, preferably having 2 to 36 carbon atoms in the main chain. Aliphatic diols are of straight-chain type or branched type. In particular, straight-chain aliphatic diols are preferable, and straight-chain aliphatic diols having 4 to 6 carbon atoms are more preferable. The diol component may comprise multiple types of diols. Preferably, the content rate of the straight-chain aliphatic diol in the total diol component is 80% by mol or more, more preferably 90% by mol or more. When the content rate is 80% by mol or more, crystallinity of the resin improves, low-temperature fixability and heat-resistant storage stability go together, and hardness of the resin improves, which is advantageous.

Specific examples of the straight-chain aliphatic diol include, but are not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,15-pentadecanediol, 1,16-hexadecanediol, 1,17-heptadecanediol, 1,18-octadecanediol, and 1,20-eicosanediol. Among these, ethylene glycol, 1,3-propanediol, 1,4-butanediol, 1,6-hexanediol, 1,9-nonanediol, and 1,10-decanediol are preferable because they are readily available; and 1,4-butanediol and 1,6-hexanediol are more preferable.

Specific examples of other diols to be used as necessary include, but are not limited to, aliphatic diols having 2 to 36 carbon atoms (e.g., 1,2-propylene glycol, 1,3-butanediol, hexanediol, octanediol, decanediol, dodecanediol, tetradecanediol, neopentyl glycol, and 2,2-diethyl-1,3-propanediol) other than the above-described diols; alkylene ether glycols having 4 to 36 carbon atoms (e.g., diethylene glycol, triethylene glycol, dipropylene glycol, polyethylene glycol, polypropylene glycol, and polytetramethylene ether glycol); alicyclic diols having 4 to 36 carbon atoms (e.g., 1,4-cyclohexanedimethanol and hydrogenated bisphenol A); alkylene oxide ("AO") (e.g., ethylene oxide ("EO"), propylene oxide ("PO"), and butylene oxide ("BO")) adducts (with an adduct molar number of from 1 to 30) of the alicyclic diols; AO (e.g., EO, PO, and BO) adducts (with an adduct molar number of from 2 to 30) of bisphenols (e.g., bisphenol A, bisphenol F, and bisphenol S); polylactone diols (e.g., poly-ε-caprolactone diol); and polybutadiene diols.

Specific examples of alcohols having 3 to 8 or more valences to be used as necessary include, but are not limited to, polyvalent aliphatic alcohols having 3 to 36 carbon atoms and 3 to 8 or more valences (e.g., alkane polyols and intramolecular or intermolecular dehydration product thereof, such as glycerin, trimethylolethane, trimethylolpropane, pentaerythritol, sorbitol, sorbitan, and polyglycerin); sugars and derivatives thereof (e.g., sucrose and methyl glucoside); AO adduct (with an adduct molar number of from 2 to 30) of trisphenols (e.g., trisphenol PA); AO adduct (with an adduct molar number of from 2 to 30) of novolac resins (e.g., phenol novolac and cresol novolac); and acrylic polyols (e.g., copolymer of hydroxyethyl (meth)acrylate and other vinyl monomer). Among these, polyvalent aliphatic alcohols having 3 to 8 or more valences and AO adducts of novolac resins are preferable; and AO adducts of novolac resin are more preferable.

Dicarboxylic Acid Component

Preferred examples of the dicarboxylic acid component include aliphatic dicarboxylic acids and aromatic dicarboxylic acids. Aliphatic dicarboxylic acids are of straight-chain type or branched type. In particular, straight-chain dicarboxylic acids are preferable. Among straight chain dicarboxylic acids, saturated aliphatic dicarboxylic acids having 6 to 12 carbon atoms are particularly preferable.

Specific examples of the dicarboxylic acids include, but are not limited to, alkanedicarboxylic acids having 4 to 36 carbon atoms (e.g., succinic acid, adipic acid, azelaic acid, sebacic acid, dodecanedioic acid, tetradecanedioic acid, hexadecanedioic acid, and octadecanedioic acid); alicyclic dicarboxylic acids having 6 to 40 carbon atoms (e.g., dimmer acids such as dimerized linoleic acid); alkenedicarboxylic acids having 4 to 36 carbon atoms (e.g., alkenyl succinic acids such as dodecenyl succinic acid, pentadecenyl succinic acid, and octadecenyl succinic acid; and maleic acid, fumaric acid, and citraconic acid); and aromatic dicarboxylic acids having 8 to 36 carbon atoms (e.g., phthalic acid, isophthalic acid, terephthalic acid, t-butyl isophthalic acid, 2,6-naphthalenedicarboxylic acid, and 4,4'-biphenyl dicarboxylic acid).

Specific examples of polycarboxylic acids having 3 to 6 or more valences to be used as necessary include, but are not limited to, aromatic polycarboxylic acids having 9 to 20 carbon atoms (e.g., trimellitic acid and pyromellitic acid).

Additionally, acid anhydrides and C1-C4 lower alkyl esters (e.g., methyl ester, ethyl ester, and isopropyl ester) of the above-described dicarboxylic acids and polycarboxylic acids having 3 to 6 or more valences may also be used.

Among the above dicarboxylic acids, it is preferable that one type of the aliphatic dicarboxylic acid (preferably, adipic acid, sebacic acid, or dodecanedioic acid) is used alone or in combination with others. In addition, a copolymer of an aliphatic dicarboxylic acid with an aromatic dicarboxylic acid (preferably, terephthalic acid, isophthalic acid, t-butyl isophthalic acid, or a lower alkyl ester thereof) is also preferable. The content rate of the aromatic dicarboxylic acid in the copolymer is preferably 20% by mol or less.

Ring-Opened Polymer of Lactone

The ring-opened polymer of lactone, serving as the polyester resin, may be obtained by a ring-opening polymerization of lactones (e.g., monolactones (having one ester group in the ring) having 3 to 12 carbon atoms, such as β-propiolactone, γ-butyrolactone, δ-valerolactone, and ε-caprolactone) in the presence of a catalyst (e.g., metal oxide and organic metallic compound.) Among the above lactones, ε-caprolactone is preferable for crystallinity.

The ring-opened polymer of lactone may be obtained by a ring-opening polymerization of the above lactone with the use of a glycol (e.g., ethylene glycol and diethylene glycol) as an initiator, so that hydroxyl group is introduced to a terminal. The terminal hydroxyl group may be further modified into carboxyl group. Additionally, commercially-available products of the ring-opened polymer of lactone may also be used, such as PLACCEL series H1P, H4, H5, and H7 from DAICEL CORPORATION, which are high crystallinity polycaprolactones.

Polyhydroxycarboxylic Acid

The polyhydroxycarboxylic acid, serving as the polyester resin, may be directly obtained by a dehydration condensation of a hydroxycarboxylic acid such as glycolic acid and lactic acid (in L-form, D-form, or racemic form). However, the polyhydroxycarboxylic acid is preferably obtained by a ring-opening polymerization of a cyclic ester (having 2 to 3 ester groups in the ring) having 4 to 12 carbon atoms, that is a product of an intermolecular dehydration condensation among two or three molecules of a hydroxycarboxylic acid such as glycolic acid and lactic acid (in L-form, D-form, or racemic form), in the presence of a catalyst (e.g., metal oxide and organic metallic compound), for adjusting molecular weight. Preferred examples of the cyclic ester include L-lactide and D-lactide in view of crystallinity. The polyhydroxycarboxylic acid may be modified such that hydroxyl group or carboxyl group is introduced to a terminal.

Isocyanate Component Having 2 or More Valences

Examples of the isocyanate component include aromatic isocyanates, aliphatic isocyanates, alicyclic isocyanates, and aromatic aliphatic isocyanates. Preferred examples of the isocyanate component include: aromatic diisocyanates having 6 to 20 carbon atoms, aliphatic diisocyanates having 2 to 18 carbon atoms, alicyclic diisocyanates having 4 to 15 carbon atoms, and aromatic aliphatic diisocyanates having 8 to 15 carbon atoms (here, the number of carbon atoms in NCO groups are excluded); modified products of these diisocyanates (e.g., modified products having urethane group, carbodiimide group, allophanate group, urea group, biuret group, uretdione group, uretonimine group, isocyanurate group, or oxazolidone group); and mixtures of two or more of these compounds. An isocyanate having 3 or more valences may be used in combination as necessary.

Specific examples of the aromatic isocyanates include, but are not limited to, 1,3-phenylene diisocyanate, 1,4-phenylene diisocyanate, 2,4-tolylene diisocyanate (TDI), 2,6-tolylene diisocyanate (TDI), crude TDI, 2,4'-diphenylmethane diisocyanate (MDI), 4,4'-diphenylmethane diisocyanate (MDI), crude MDI [also known as polyallyl polyisocyanate (PAPI), that is a phosgenation product of crude diaminophenylmethane (that is a condensation product of formaldehyde with an aromatic amine (e.g., aniline) or mixture thereof, where the "an aromatic amine (e.g., aniline)

or mixture thereof" includes a mixture of diaminodiphenylmethane with a small amount (e.g., 5 to 20% by mass) of a polyamine having 3 or more functional groups)], 1,5-naphthylene diisocyanate, 4,4',4"-triphenylmethane triisocyanate, m-isocyanatophenylsulfonyl isocyanate, and p-isocyanatophenylsulfonyl isocyanate.

Specific examples of the aliphatic isocyanates include, but are not limited to, ethylene diisocyanate, tetramethylene diisocyanate, hexamethylene diisocyanate (HDI), dodecamethylene diisocyanate, 1,6,11-undecane triisocyanate, 2,2,4-trimethylhexamethylene diisocyanate, lysine diisocyanate, 2,6-diisocyanatomethyl caproate, bis(2-isocyanatoethyl) fumarate, bis(2-isocyanatoethyl) carbonate, and 2-isocyanatoethyl-2,6-diisocyanatohexanoate.

Specific examples of the alicyclic isocyanates include, but are not limited to, isophorone diisocyanate (IPDI), dicyclohexylmethane-4,4'-diisocyanate (hydrogenated MDI), cyclohexylene diisocyanate, methylcyclohexylene diisocyanate (hydrogenated TDI), bis(2-isocyanatoethyl)-4-cyclohexene-1,2-dicarboxylate, 2,5-norbornane diisocyanate, and 2,6-norbornane diisocyanate.

Specific examples of the aromatic aliphatic isocyanates include, but are not limited to, m-xylylene diisocyanate (XDI), p-xylylene diisocyanate (XDI), and $\alpha,\alpha,\alpha',\alpha'$-tetramethylxylylene diisocyanate (TMXDI).

The modified products of the diisocyanates include those having urethane group, carbodiimide group, allophanate group, urea group, biuret group, uretdione group, uretonimine group, isocyanurate group, or oxazolidone group. Specifically, examples of the modified products of the diisocyanates include, but are not limited to, modified MDI (e.g., urethane-modified MDI, carbodiimide-modified MDI, and trihydrocarbyl-phosphate-modified MDI), urethane-modified TDI, and mixtures of two or more of these compounds (e.g., a combination of modified MDI and urethane-modified TDI (i.e., a prepolymer having an isocyanate group)).

Among these compounds, preferred are aromatic diisocyanates having 6 to 15 carbon atoms, aliphatic diisocyanates having 4 to 12 carbon atoms, alicyclic diisocyanates having 4 to 15 carbon atoms (here, the number of carbon atoms in NCO groups are excluded); and more preferred are TDI, MDI, HDI, hydrogenated MDI, and IPDI.

Urea-Modified Polyester Resin

The urea-modified polyester resin may be obtained by a reaction between a polyester resin having a terminal isocyanate group and an amine compound.

Amine Component Having 2 or More Valences

Examples of the amine component include aliphatic amines and aromatic amines. Preferred examples of the amine component include aliphatic diamines having 2 to 18 carbon atoms and aromatic diamines having 6 to 20 carbon atoms. An amine having 3 or more valences may be used in combination as necessary.

Specific examples of the aliphatic diamines having 2 to 18 carbon atoms include, but are not limited to: alkylene diamines having 2 to 6 carbon atoms (e.g., ethylenediamine, propylenediamine, trimethylenediamine, tetramethylenediamine, and hexamethylenediamine); polyalkylene diamines having 4 to 18 carbon atoms (e.g., diethylenetriamine, iminobispropylamine, bis(hexamethylene)triamine, triethylenetetramine, tetraethylenepentamine, and pentaethylenehexamine); C1-C4 alkyl or C2-C4 hydroxyalkyl substitutes of the above compounds (e.g., dialkylaminopropylamine, trimethylhexamethylenediamine, aminoethylethanolamine, 2,5-dimethyl-2,5-hexamethylenediamine, and methyliminobispropylamine); alicyclic or heterocyclic aliphatic diamines (e.g., alicyclic diamines having 4 to 15 carbon atoms, such as 1,3-diaminocyclohexane, isophoronediamine, mentheneediamine, and 4,4'-methylenedicyclohexanediamine (hydrogenated methylenedianiline); and heterocyclic diamines having 4 to 15 carbon atoms, such as piperazine, N-aminoethylpiperazine, 1,4-diaminoethylpiperazine, 1,4-bis(2-amino-2-methylpropyl)piperazine, and 3,9-bis(3-aminopropyl)-2,4,8,10-tetraoxaspiro[5,5]undecane); and aromatic aliphatic amines having 8 to 15 carbon atoms (e.g., xylylenediamine and tetrachloro-p-xylylenediamine).

Specific examples of the aromatic diamines having 6 to 20 carbon atoms include, but are not limited to: unsubstituted aromatic diamines (e.g., 1,2-phenylenediamine, 1,3-phenylenediamine, 1,4-phenylenediamine, 2,4'-diphenylmethanediamine, 4,4'-diphenylmethanediamine, crude diphenylmethanediamine(polyphenyl polymethylene polyamine), diaminodiphenyl sulfone, benzidine, thiodianiline, bis(3,4-diaminophenyl) sulfone, 2,6-diaminopyridine, m-aminobenzylamine, triphenylmethane-4,4',4"-triamine, and naphthylenediamine); aromatic diamines having a nuclear-substituted alkyl group having 1 to 4 carbon atoms (e.g., 2,4-tolylenediamine, 2,6-tolylenediamine, crude tolylenediamine, diethyltolylenediamine, 4,4'-diamino-3,3'-dimethyldiphenylmethane, 4,4'-bis(o-toluidine), dianisidine, diaminoditolyl sulfone, 1,3-dimethyl-2,4-diaminobenzene, 1,3-dimethyl-2,6-diaminobenzene, 1,4-diisopropyl-2,5-diaminobenzene, 2,4-diaminomesitylene, 1-methyl-3,5-diethyl-2,4-diaminobenzene, 2,3-dimethyl-1,4-diaminonaphthalene, 2,6-dimethyl-1,5-diaminonaphthalene, 3,3',5,5'-tetramethylbenzidine, 3,3',5,5'-tetramethyl-4,4'-diaminodiphenylmethane, 3,5-diethyl-3'-methyl-2',4-diaminodiphenylmethane, 3,3'-diethyl-2,2'-diaminodiphenylmethane, 4,4'-diamino-3,3'-dimethyldiphenylmethane, 3,3',5,5'-tetraethyl-4,4'-diaminobenzophenone, 3,3',5,5'-tetraethyl-4,4'-diaminodiphenyl ether, and 3,3',5,5'-tetraisopropyl-4,4'-diaminodiphenyl sulfone) and mixtures of isomers thereof at various mixing ratios; aromatic diamines having a nuclear-substituted electron withdrawing group (e.g., halogen group such as Cl, Br, I, and F; alkoxy group such as methoxy group and ethoxy group; and nitro group), such as methylenebis-o-chloroaniline, 4-chloro-o-phenylenediamine, 2-chloro-1,4-phenylenediamine, 3-amino-4-chloroaniline, 4-bromo-1,3-phenylenediamine, 2,5-dichloro-1,4-phenylenediamine, 5-nitro-1,3-phenylenediamine, 3-dimethoxy-4-aminoaniline, 4,4'-diamino-3,3'-dimethyl-5,5'-dibromo-diphenylmethane, 3,3'-dichlorobenzidine, 3,3'-dimethoxybenzidine, bis(4-amino-3-chlorophenyl) oxide, bis(4-amino-2-chlorophenyl)propane, bis(4-amino-2-chlorophenyl) sulfone, bis(4-amino-3-methoxyphenyl)decane, bis(4-aminophenyl) sulfide, bis(4-aminophenyl) telluride, bis(4-aminophenyl) selenide, bis(4-amino-3-methoxyphenyl) disulfide, 4,4'-methylenebis(2-iodoaniline), 4,4'-methylenebis(2-bromoaniline), 4,4'-methylenebis(2-fluoroaniline), and 4-aminophenyl-2-chloroaniline); and aromatic diamines having a secondary amino group (i.e., the above unsubstituted aromatic diamines, aromatic diamines having a nuclear-substituted alkyl group having 1 to 4 carbon atoms and mixtures of isomers thereof at various mixing ratios, and aromatic diamines having a nuclear-substituted electron withdrawing group, in which part or all of primary amino groups are substituted with a secondary amino group with a lower alkyl group (e.g., methyl group and ethyl group), such as 4,4'-di(methylamino)diphenylmethane and 1-methyl-2-methylamino-4-aminobenzene).

Specific examples of the amines having 3 or more valences include, but are not limited to, polyamide polyamines (such as low-molecular-weight polyamine polyamine obtainable by a condensation between a dicarboxylic acid (e.g., dimer acid) and an excessive amount (i.e., 2 mol or more per 1 mol of acid) of a polyamine (e.g., alkylenediamine and polyalkylene polyamine)) and polyamine polyamines (such as hydrides of cyanoethylation products of polyether polyol (e.g., polyalkylene glycol)).

Polyurethane Resin

Examples of the polyurethane resin include polyurethane resins obtained from a diol component and a diisocyanate component. An alcohol component having 3 or more valences and an isocyanate component may be used in combination as necessary.

Specific examples of the diol component, diisocyanate component, alcohol component having 3 or more valences, and isocyanate component include those exemplified above.

Polyurea Resin

Examples of the polyurea resin include polyurea resins obtained from a diamine component and a diisocyanate component. An amine component having 3 or more valences and an isocyanate component may be used in combination as necessary.

Specific examples of the diamine component, diisocyanate component, amine component having 3 or more valences, and isocyanate component include those exemplified above.

Melting Point of Crystalline Resin

The largest peak temperature of melting heat of the crystalline resin is preferably from 45° C. to 70° C., more preferably from 53° C. to 65° C., and most preferably from 58° C. to 62° C., for achieving both low-temperature fixability and heat-resistant storage stability. When the largest peak temperature is 45° C. or higher, low-temperature fixability and heat-resistant storage stability of the toner can be well maintained, and aggregation of toner and carrier caused due to stirring stress in the developing device can be effectively prevented. When the largest peak temperature is 70° C. or lower, low-temperature fixability and heat-resistant storage stability of the toner can be well maintained.

The ratio of the softening temperature to the largest peak temperature of melting heat of the crystalline resin is preferably from 0.80 to 1.55, more preferably from 0.85 to 1.25, much more preferably from 0.90 to 1.20, and most preferably from 0.90 to 1.19. The closer to 1.00 this ratio becomes, the more rapidly the resin softens, which is advantageous for achieving both low-temperature fixability and heat-resistant storage stability.

The crystalline resin preferably has a weight average molecular weight (Mw) of from 10,000 to 40,000, more preferably from 15,000 to 35,000, and most preferably from 20,000 to 30,000, for achieving both low-temperature fixability and heat-resistant storage stability. When Mw is 10,000 or higher, deterioration of heat-resistant storage stability of the toner is effectively prevented. When Mw is 40,000 or lower, deterioration of low-temperature fixability of the toner is effectively prevented.

The weight average molecular weight (Mw) of resin can be measured by a gel permeation chromatographic ("GPC") instrument (such as HLC-8220 GPC available from Tosoh Corporation). As columns, TSKgel SuperHZM-H 15 cm in 3-tandem (available from Tosoh Corporation) may be used. A resin to be measured is dissolved in tetrahydrofuran ("THF" containing a stabilizer, available from Wako Pure Chemical Industries, Ltd.) to prepare a 0.15 wt % solution thereof. The solution is filtered with a 0.2-μm filter and the filtrate is used as a sample in succeeding procedures. Next, 100 μL of the sample (i.e., THF solution of the resin) is injected into the instrument and subjected to a measurement at 40° C. and a flow rate of 0.35 mL/min. The molecular weight of the sample is determined by comparing the molecular weight distribution of the sample with a calibration curve, compiled with several types of monodisperse polystyrene standard samples, that shows the relation between the logarithmic values of molecular weights and the number of counts. The standard polystyrene samples used to create the calibration curve include SHOWDEX STANDARD Std. No. S-7300, S-210, S-390, S-875, S-1980, S-10.9, S-629, S-3.0, and S-0.580 available from Showa Denko K.K. and toluene. As the detector, a refractive index (RI) detector is used.

The crystalline resin may be a block resin having a crystalline unit and a non-crystalline unit. The crystalline unit may comprise the above-described crystalline resin. The non-crystalline resin unit may comprise polyester resin, polyurethane resin, and/or polyurea resin. The composition of the non-crystalline unit may be similar to that of the crystalline resin. Specific examples of monomers for forming the non-crystalline unit include the above-exemplified diol components, dicarboxylic acid components, diisocyanate components, diamine components, and combinations thereof, but are not limited thereto.

The crystalline resin may be produced by causing a reaction between a crystalline resin precursor having a terminal functional group reactive with an active hydrogen group and a resin or compound (e.g., cross-linking agent and elongating agent) having an active hydrogen group, to thereby increase the molecular weight of the crystalline resin precursor, during the process of producing the toner. The crystalline resin precursor may be obtained by a reaction of a crystalline polyester resin, urethane-modified crystalline polyester resin, urea-modified crystalline polyester resin, crystalline polyurethane resin, or crystalline polyurea resin with a compound having a functional group reactive with an active hydrogen group.

Specific examples of the functional group reactive with an active hydrogen group include, but are not limited to, isocyanate group, epoxy group, carboxylic acid group, and an acid chloride group. Among these, isocyanate group is preferable for reactivity and safety. Specific examples of the compound having an isocyanate group include, but are not limited to, the above-described diisocyanate components.

In a case in which the crystalline resin precursor is obtained by a reaction between a crystalline polyester resin and the diisocyanate component, the crystalline polyester resin preferably has hydroxyl group on its terminal.

The crystalline polyester resin having hydroxyl group may be obtained by a reaction between a diol component and a dicarboxylic acid, where the equivalent ratio [OH]/[COOH] of hydroxyl groups [OH] from the diol component to carboxyl groups [COOH] from the dicarboxylic acid component is preferably from 2/1 to 1/1, more preferably from 1.5/1 to 1/1, and most preferably from 1.3/1 to 1.02/1.

With regard to the use amount of the compound having a functional group reactive with an active hydrogen group, in a case in which the crystalline polyester resin precursor is obtained by a reaction between the crystalline polyester resin having hydroxyl group with the diisocyanate component, the equivalent ratio [NCO]/[OH] of isocyanate groups [NCO] from the diisocyanate component to hydroxyl groups [OH] from the crystalline polyester resin having hydroxyl group is preferably from 5/1 to 1/1, more preferably from 4/1 to 1.2/1, and most preferably from 2.5/1 to 1.5/1. This ratio is unchanged, although the structural components may be varied, even when the crystalline resin precursor has another type of skeleton or terminal group.

The resin or compound (e.g., cross-linking agent and elongating agent) having an active hydrogen group is not limited to any particular material so long as having an active hydrogen group. In a case in which the functional group reactive with an active hydrogen group is an isocyanate group, resins and compounds having hydroxyl group (e.g., alcoholic hydroxyl group and phenolic hydroxyl group), amino group, carboxyl group, or mercapto group are preferable. In particular, water and amines are preferable in view of reaction speed.

Specific examples of the amines include, but are not limited to phenylenediamine, diethyltoluenediamine, 4,4'-diaminodiphenylmethane, 4,4'-diamino-3,3'-dimethyldicyclohexylmethane, diaminocyclohexane, isophoronediamine, ethylenediamine, tetramethylenediamine, hexamethylenediamine, diethylenetriamine, triethylenetetramine, ethanolamine, hydroxyethylaniline, aminoethyl mercaptan, aminopropyl mercaptan, aminopropionic acid, and aminocaproic acid. In addition, ketimine compounds obtained by blocking amino group in the above-described compounds with ketones (e.g., acetone, methyl ethyl ketone, methyl isobutyl ketone), and oxazoline compounds, may also be used.

Other Components

The toner may further contain a binder resin and a release agent in addition to the plate-like pigment. The binder resin and release agent are not limited to any particular material and can be selected from known materials. Other than the above-described crystalline resin and wax capable of being in a needle-like or plate-like state, generally-used release agents and binder resins (e.g., amorphous polyester resins) may be used in the present disclosure.

The toner may further contain other components such as a colorant, a charge control agent, an external additive, a fluidity improving agent, a cleaning improving agent, and a magnetic material.

Colorant

Examples of the colorant that can be used in combination with the plate-like pigment include the following materials.

Specific examples of black colorants include, but are not limited to, carbon blacks (C.I. Pigment Black 7) such as furnace black, lamp black, acetylene black, and channel black; metals such as copper, iron (C.I. Pigment Black 11), and titanium oxide; and organic pigments such as aniline black (C.I. Pigment Black 1).

Specific examples of magenta colorants include, but are not limited to, C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:1, 49, 50, 51, 52, 53, 53:1, 54, 55, 57, 57:1, 58, 60, 63, 64, 68, 81, 83, 87, 88, 89, 90, 112, 114, 122, 123, 150, 163, 177, 179, 184, 202, 206, 207, 209, 211, and 269; C.I. Pigment Violet 19; and C.I. Vat Red 1, 2, 10, 13, 15, 23, 29, and 35.

Specific examples of cyan colorants include, but are not limited to, C.I. Pigment Blue 2, 3, 15, 15:1, 15:2, 15:3, 15:4, 15:6, 16, 17, and 60; C.I. Vat Blue 6; and C.I. Acid Blue 45; a copper phthalocyanine pigment having a phthalocyanine skeleton is substituted with 1 to 5 phthalimide methyl groups; and Green 7 and Green 36.

Specific examples of yellow colorants include, but are not limited to, C.I. Pigment Yellow 1, 2, 3, 4, 5, 6, 7, 10, 11, 12, 13, 14, 15, 16, 17, 23, 55, 65, 73, 74, 83, 97, 110, 139, 151, 154, 155, 180, and 185; C.I. Vat Yellow 1, 3, 20; and Orange 36.

The content rate of the colorant in the toner is preferably from 1% to 15% by mass, more preferably from 3% to 10% by mass. When the content rate is 1% by mass or more, deterioration of coloring power of the toner can be prevented. When the content rate is 15% by mass or less, defective dispersion of the colorant in the toner can be prevented, and deterioration of coloring power and electrical property of the toner can be effectively prevented.

The colorant may be combined with a resin to be used as a master batch. The resin is not limited to any particular resin, but the resin preferably has a similar structure to the binder resin in terms of compatibility.

The master batch may be obtained by mixing and kneading the resin and the colorant while applying a high shearing force thereto. To increase the interaction between the colorant and the resin, an organic solvent may be used. More specifically, the maser batch may be obtained by a method called flushing in which an aqueous paste of the colorant is mixed and kneaded with the resin and the organic solvent so that the colorant is transferred to the resin side, followed by removal of the organic solvent and moisture. This method is advantageous in that the resulting wet cake of the colorant can be used as it is without being dried. The mixing and kneading is preferably performed by a high shearing dispersing device such as a three roll mill.

Charge Controlling Agent

The toner may contain a charge controlling agent for imparting appropriate charging ability to the toner.

Any known charge controlling agent is usable. Since a colored material may change the color tone of the toner, colorless or whitish materials are preferably used for the charge controlling agent. Specific examples of such materials include, but are not limited to, triphenylmethane dyes, chelate pigments of molybdic acid, Rhodamine dyes, alkoxyamines, quaternary ammonium salts (including fluorine-modified quaternary ammonium salts), alkylamides, phosphor and phosphor-containing compounds, tungsten and tungsten-containing compounds, fluorine activators, metal salts of salicylic acid, and metal salts of salicylic acid derivatives. Each of these materials may be used alone or in combination with others.

The content rate of the charge controlling agent is determined based on the type of binder resin used and toner manufacturing method (including dispersing method), and is not limited to any particular value. Preferably, the content rate is from 0.01% to 5% by mass, more preferably from 0.02% to 2% by mass, based on the amount of the binder resin. When the content rate is 5% by mass or less, the charge of the toner is not so large that the effect of the charge controlling agent is exerted and the electrostatic attraction force between the toner and a developing roller is suppressed. Thus, lowering of developer fluidity and deterioration of image density can be effectively prevented. When the content rate is 0.01% by mass or more, the charge rising property and charge quantity are sufficient.

External Additive

For the purpose of improving fluidity, adjusting charge quantity, and/or adjusting electrical properties, external additives may be added to the toner. Specific examples of the external additive include, but are not limited to, silica fine particles, hydrophobized silica fine particles, metal salts of fatty acids (e.g., zinc stearate and aluminum stearate), metal oxides (e.g., titania, alumina, tin oxide, and antimony oxide) and hydrophobized products thereof, and fluoropolymers. Among these, hydrophobized silica fine particles, titania fine particles, and hydrophobized titania fine particles are preferable.

Specific examples of commercially-available hydrophobized silica fine particles include, but are not limited to, HDK H 2000, HDK H 2000/4, HDK H 2050EP, HVK 21, and HDK H 1303 (available from Hoechst AG); and R972, R974, RX200, RY200, R202, R805, and R812 (available from Nippon Aerosil Co., Ltd.). Specific examples of commercially-available titania fine particles include, but are not limited to, P-25 (available from Nippon Aerosil Co., Ltd.); STT-30 and STT-65CS (available from Titan Kogyo, Ltd.); TAF-140 (available from Fuji Titanium Industry Co., Ltd.); and MT-150W, MT-500B, MT-600B, and MT-150A (available from TAYCA Corporation). Specific examples of commercially available hydrophobized titanium oxide fine particles include, but are not limited to, T-805 (available from Nippon Aerosil Co., Ltd.); STT-30A and STT-65S-S (available from Titan Kogyo, Ltd.); TAF-500T and TAF-1500T (available from Fuji Titanium Industry Co., Ltd.); MT-100S and MT-100T (available from TAYCA Corporation); and IT-S (available from Ishihara Sangyo Kaisha, Ltd.).

The hydrophobized fine particles of silica, titania, and alumina can be obtained by treating fine particles of silica, titania, and alumina, respectively, which are hydrophilic, with a silane coupling agent such as methyltrimethoxysilane, methyltriethoxysilane, and octyltrimethoxysilane. Specific examples of usable hydrophobizing agents include, but are not limited to, silane coupling agents such as dialkyl dihalogenated silane, trialkyl halogenated silane, alkyl trihalogenated silane, and hexaalkyl disilazane; silylation agents; silane coupling agents having a fluorinated alkyl group; organic titanate coupling agents; aluminum coupling agents; silicone oils; and silicone varnishes.

Preferably, primary particles of the external additive have an average particle diameter of from 1 to 100 nm, more preferably from 3 to 70 nm. When the average particle diameter is 1 nm or more, a problem such that the external additive is embedded in the toner without effectively exerting its function can be effectively prevented. When the average particle diameter is 100 nm or less, a problem such that the surface of a photoconductor is non-uniformly damaged can be effectively prevented. The external additive may comprise a combination of inorganic fine particles with hydrophobized inorganic fine particles. More preferably, the external additive comprises at least two types of hydrophobized inorganic fine particles each having an average primary particle diameter of 20 nm or less and at least one type of hydrophobized inorganic fine particle having an average primary particle diameter of nm or more. The BET specific surface area of the inorganic fine particles is preferably from 20 to 500 $m^2/g$.

Preferably, the content rate of the external additive in the toner is from 0.1% to 5% by mass, more preferably from 0.3% to 3% by mass.

Specific examples of the external additive further include resin fine particles. Specific examples of the resin fine particles include, but are not limited to, polystyrene particles obtained by soap-free emulsion polymerization, suspension polymerization, or dispersion polymerization; particles of copolymer of methacrylates and/or acrylates; particles of polycondensation polymer such as silicone, benzoguanamine, and nylon; and thermosetting resin particles. By using such resin fine particles in combination, chargeability of the toner is enhanced, the amount of reversely-charged toner particles is reduced, and the degree of background fouling is reduced.

The content rate of the resin fine particles in the toner is preferably from 0.01% to 5% by mass, more preferably from 0.1% to 2% by mass.

Electrical Properties of Toner

Preferably, the common logarithm Log R of the volume resistivity R (Ωcm) of the toner is in the range of from 10.5 to 11.5 (Log Ωcm). When the common logarithm Log R is 10.5 Log Ωcm or more, conductivity is increased and thereby the occurrence of defective charging, background fouling, and toner scattering can be effectively prevented. When the common logarithm Log R is 11.5 Log Ωcm or less, electrical resistivity and charge amount are increased and lowering of image density can be effectively prevented.

In the toner in accordance with some embodiments of the present invention, when the average distance H of the plate-like pigment particles is 0.5 μm or more, the distance between the planes of the plate-like pigment particles is sufficiently secured and thereby the volume resistivity comes into the preferable range. In addition, even when the toner is deteriorated by stress, the electrical resistivity of the toner is prevented from decreasing.

Method for Producing Toner

The toner may be produced by known methods by using known materials. For example, the toner may be produced by a kneading pulverization method or a chemical method that granulates toner particles in an aqueous medium.

In particular, the toner in accordance with some embodiments of the present invention is preferably embodied by a dissolution suspension method in which a toner binder resin, a colorant, etc., are dissolved or dispersed in an organic solvent to prepare oil droplets, or a suspension polymerization method that uses radical polymerizable monomer.

More preferably, the toner is produced by a method including the process of dispersing an organic liquid in an aqueous medium to prepare an oil-in-water emulsion, where the organic liquid contains the plate-like pigment and optionally a substance capable of being in at least one of a needle-like state or a plate-like state. As oil droplets are formed in the aqueous medium, the plate-like pigment particles and other needle-like or plate-like particles are allowed to freely move in the oil droplets and prevented from being aligned in one direction. The oil droplets thereafter become toner particles in which the plate-like pigment particles and the needle-like or plate-like substance are fixed.

Dissolution Suspension Method and Suspension Polymerization Method

The dissolution suspension method may include the processes of dissolving or dispersing toner components including at least a binder resin or resin precursor, a colorant, and a wax in an organic solvent to prepare an oil phase composition, and dispersing or emulsifying the oil phase composition in an aqueous medium, to prepare mother particles of the toner.

Preferably, the organic solvent in which the toner components are dissolved or dispersed is a volatile solvent having a boiling point of less than 100° C., for easy removal of the organic solvent in the succeeding process.

Specific examples of such organic solvents include, but are not limited to, ester-based or ester-ether-based solvents such as ethyl acetate, butyl acetate, methoxybutyl acetate, methyl cellosolve acetate, and ethyl cellosolve acetate; ether-based solvents such as diethyl ether, tetrahydrofuran, dioxane, ethyl cellosolve, butyl cellosolve, and propylene glycol monomethyl ether; ketone-based solvents such as acetone, methyl ethyl ketone, methyl isobutyl ketone, di-n-butyl ketone, and cyclohexanone; alcohol-based solvents such as methanol, ethanol, n-propanol, isopropanol, n-butanol, isobutanol, t-butanol, 2-ethylhexyl alcohol, and benzyl alcohol; and mixtures of two or more of the above solvents.

In the dissolution suspension method, at the time when the oil phase composition is dispersed or emulsified in the aqueous medium, an emulsifier or dispersant may be used, as necessary.

Examples of the emulsifier or dispersant include, but are not limited to, surfactants and water-soluble polymers. Specific examples of the surfactants include, but are not limited to, anionic surfactants (e.g., alkylbenzene sulfonate and phosphate), cationic surfactants (e.g., quaternary ammonium salt type and amine salt type), ampholytic surfactants (e.g., carboxylate type, sulfate salt type, sulfonate type, and phosphate salt type), and nonionic surfactants (e.g., AO-adduct type and polyol type).

Each of these surfactants can be used alone or in combination with others.

Specific examples of the water-soluble polymers include, but are not limited to, cellulose compounds (e.g., methyl cellulose, ethyl cellulose, hydroxyethyl cellulose, ethyl hydroxyethyl cellulose, carboxymethyl cellulose, hydroxypropyl cellulose, and saponification products thereof), gelatin, starch, dextrin, gum arabic, chitin, chitosan, polyvinyl alcohol, polyvinylpyrrolidone, polyethylene glycol, polyethyleneimine, polyacrylamide, acrylic-acid-containing or acrylate-containing polymers (e.g., sodium polyacrylate, potassium polyacrylate, ammonium polyacrylate, sodium hydroxide partial neutralization product of polyacrylic acid, and sodium acrylate-acrylate copolymer), sodium hydroxide (partial) neutralization product of styrene-maleic anhydride copolymer, and water-soluble polyurethanes (e.g. reaction product of polyethylene glycol or polycaprolactone with polyisocyanate).

In addition, the above organic solvents and plasticizers may be used in combination as an auxiliary agent for emulsification or dispersion.

Preferably, mother particles of the toner are produced by a dissolution suspension method including the process of dispersing or emulsifying an oil phase composition in an aqueous medium containing resin fine particles, where the oil phase composition contains at least a binder resin, a binder resin precursor having a functional group reactive with an active hydrogen group ("prepolymer having a reactive group"), a colorant, and a wax, to allow the prepolymer having a reactive group to react with a compound having an active hydrogen group that is contained in the oil phase composition and/or the aqueous medium.

The resin fine particles may be produced by a known polymerization method, and is preferably obtained in the form of an aqueous dispersion thereof.

An aqueous dispersion of resin fine particles may be prepared by, for example, one of the following methods (a) to (h).

(a) Subjecting a vinyl monomer as a starting material to one of suspension polymerization, emulsion polymerization, seed polymerization, and dispersion polymerization, thereby directly preparing an aqueous dispersion of resin fine particles.

(b) Dispersing a precursor (e.g., monomer and oligomer) of a polyaddition or polycondensation resin (e.g., polyester resin, polyurethane resin, and epoxy resin) or a solvent solution thereof in an aqueous medium in the presence of a dispersant, and allowing the precursor to cure by application of heat or addition of a curing agent, thereby preparing an aqueous dispersion of resin fine particles.

(c) Dissolving an emulsifier in a precursor (e.g., monomer and oligomer) of a polyaddition or polycondensation resin (e.g., polyester resin, polyurethane resin, and epoxy resin) or a solvent solution thereof (preferably in a liquid state, may be liquefied by application of heat), and adding water thereto to cause phase-inversion emulsification, thereby preparing an aqueous dispersion of resin fine particles.

(d) Pulverizing a resin produced by a polymerization reaction (e.g., addition polymerization, ring-opening polymerization, polyaddition, addition condensation, and condensation polymerization) into particles by a mechanical rotary pulverizer or a jet pulverizer, classifying the particles by size to collect desired-size particles, and dispersing the collected particles in water in the presence of a dispersant, thereby preparing an aqueous dispersion of resin fine particles.

(d) Spraying a solvent solution of a resin produced by a polymerization reaction (e.g., addition polymerization, ring-opening polymerization, polyaddition, addition condensation, and condensation polymerization) to form resin fine particles, and dispersing the resin fine particles in water in the presence of a dispersant, thereby preparing an aqueous dispersion of resin fine particles.

(f) Adding a poor solvent to a solvent solution of a resin produced by a polymerization reaction (e.g., addition polymerization, ring-opening polymerization, polyaddition, addition condensation, and condensation polymerization), or cooling the solvent solution of the resin in a case in which the resin is dissolved in the solvent by application of heat, to precipitate resin fine particles, removing the solvent to isolate the resin fine particles, and dispersing the resin fine particles in water in the presence of a dispersant, thereby preparing an aqueous dispersion of resin fine particles.

(g) Dispersing a solvent solution of a resin produced by a polymerization reaction (e.g., addition polymerization, ring-opening polymerization, polyaddition, addition condensation, and condensation polymerization) in an aqueous medium in the presence of a dispersant, and removing the solvent by application of heat or reduction of pressure, thereby preparing an aqueous dispersion of resin fine particles.

(h) Dissolving an emulsifier in a solvent solution of a resin produced by a polymerization reaction (e.g., addition polymerization, ring-opening polymerization, polyaddition, addition condensation, and condensation polymerization), and adding water thereto to cause phase-inversion emulsification, thereby preparing an aqueous dispersion of resin fine particles.

The resin fine particles preferably have a volume average particle diameter of from to 300 nm, more preferably from 30 to 120 nm. When the volume average particle diameter of the resin fine particles is 10 nm or more and 300 nm or less, deterioration of particle size distribution of the toner can be effectively prevented.

Preferably, the oil phase has a solid content concentration of from 40% to 80%. When the concentration is too high, the oil phase becomes more difficult to emulsify or disperse in an aqueous medium, or to handle, due to high viscosity. When the concentration is too low, toner productivity decreases.

Toner components other than binder resin, such as colorant, wax, and master batch thereof, may be independently dissolved or dispersed in an organic solvent and thereafter mixed in a solution or dispersion of the binder resin.

The aqueous medium may comprise water alone or a combination of water with a water-miscible solvent. Specific examples of the water-miscible solvent include, but are not limited to, alcohols (e.g., methanol, isopropanol, and ethylene glycol), dimethylformamide, tetrahydrofuran, cellosolves (e.g., methyl cellosolve), and lower ketones (e.g., acetone and methyl ethyl ketone).

The oil phase may be dispersed or emulsified in the aqueous medium by any known dispersing equipment such as a low-speed shearing disperser, high-speed shearing disperser, frictional disperser, high-pressure jet disperser, and ultrasonic disperser. For reducing the particle size of resulting particles, a high-speed shearing disperser is preferable. When a high-speed shearing disperser is used, the revolution is typically from 1,000 to 30,000 rpm, preferably from 5,000 to 20,000 rpm, but is not limited thereto. The dispersing temperature is typically from 0° C. to 150° C. (under pressure) and preferably from 20° C. to 80° C.

The organic solvent may be removed from the resulting emulsion or dispersion by gradually heating the whole system being stirred under normal or reduced pressure to completely evaporate the organic solvent contained in liquid droplets.

Mother toner particles dispersed in the aqueous medium are washed and dried by known methods as follows. First, the dispersion is solid-liquid separated by a centrifugal separator or filter press. The resulting toner cake is re-dispersed in ion-exchange water having a temperature ranging from normal temperature to about 40° C. After optionally adjusting pH by acids and bases, the dispersion is subjected to solid-liquid separation again. These processes are repeated several times to remove impurities and surfactants. The resulting toner cake is then dried by an airflow dryer, circulation dryer, decompression dryer, or vibration fluidizing dryer, thus obtaining toner particles. Undesired ultrafine particles may be removed by a centrifugal separator during the drying process. Alternatively, the particle size distribution may be adjusted by a classifier after the drying process.

The oil phase may also be prepared by replacing the organic solvent with a radical polymerizable monomer and a polymerization initiator. As this oil phase is emulsified and the oil droplets are subjected to a polymerization by application of heat, the toner is prepared by a suspension polymerization method. Specific preferred examples of the radical polymerizable monomer include styrene, acrylate, and methacrylate monomers. The polymerization initiator may be selected from azo initiators or peroxide initiators. The suspension polymerization method needs not include a process for removing organic solvent.

The mother toner particles thus prepared may be mixed with inorganic fine particles, such as hydrophobic silica powder, for improving fluidity, storage stability, developability, and transferability.

The mixing of such external additive may be performed with a typical powder mixer, preferably equipped with a jacket for inner temperature control. To vary load history given to the external additive, the external additive may be gradually added or added from the middle of the mixing, while optionally varying the rotation number, rolling speed, time, and temperature of the mixer. The load may be initially strong and gradually weaken, or vice versa. Specific examples of usable mixers include, but are not limited to, V-type mixer, ROCKING MIXER, LOEDIGE MIXER, NAUTA MIXER, and HENSCHEL MIXER. The mother toner particles are then allowed to pass a sieve having a mesh size of 250 or more so that coarse particles and aggregated particles are removed, thereby obtaining toner particles.

Developer

The developer in accordance with some embodiments of the present invention comprises at least the above-described toner and optionally other components such as a carrier.

The developer has excellent transferability and chargeability, and is capable of reliably forming high-quality image. The developer may be either a one-component developer or a two-component developer.

The two-component developer may be prepared by mixing the above toner with a carrier. The content rate of the carrier in the two-component developer is preferably from 90% to 98% by mass, more preferably from 93% to 97% by mass.

Carrier

The carrier preferably comprises a core material and a resin layer that covers the core material.

Core Material

The core material comprises a magnetic particle. Specific preferred examples thereof include ferrite, magnetite, iron, and nickel. In consideration of environmental adaptability that has been remarkably advanced in recent years, manganese ferrite, manganese-magnesium ferrite, manganese-strontium ferrite, manganese-magnesium-strontium ferrite, and lithium ferrite are preferred rather than copper-zinc ferrite that has been conventionally used.

Toner Storage Unit

In the present disclosure, a toner storage unit refers to a unit that has a function of storing toner and that is storing the above toner. The toner storage unit may be in the form of, for example, a toner storage container, a developing device, or a process cartridge.

The toner storage container refers to a container storing the toner.

The developing device refers to a device storing the toner and having a developing unit configured to develop an electrostatic latent image into a toner image with the toner.

The process cartridge refers to a combined body of an electrostatic latent image bearer (simply "image bearer") with a developing unit storing the toner, detachably mountable on an image forming apparatus. The process cartridge may further include at least one of a charger, an irradiator, and a cleaner.

An image forming apparatus on which the toner storage unit is mounted can perform an image forming operation utilizing the above toner that is capable of forming a high-definition high-quality image with glittering property and of preventing the occurrence of electrical resistivity decrease and dielectric constant increase to prevent deterioration of electrical and charge properties.

Image Forming Apparatus and Image Forming Method

An image forming apparatus in accordance with some embodiments of the present invention includes at least an electrostatic latent image bearer, an electrostatic latent image forming device, and a developing device, and optionally other members.

An image forming method in accordance with some embodiments of the present invention includes at least an electrostatic latent image forming process and a developing process, and optionally other processes.

The image forming method is preferably performed by the image forming apparatus. The electrostatic latent image forming process is preferably performed by the electrostatic latent image forming device. The developing process is preferably performed by the developing device. Other optional processes are preferably performed by other optional members.

More preferably, the image forming apparatus includes: an electrostatic latent image bearer; an electrostatic latent image forming device configured to form an electrostatic latent image on the electrostatic latent image bearer; a developing device containing the above toner, configured to develop the electrostatic latent image formed on the electrostatic latent image bearer into a toner image with the toner; a transfer device configured to transfer the toner image from the electrostatic latent image bearer onto a surface of a recording medium; and a fixing device configured to fix the toner image on the surface of the recording medium.

More preferably, the image forming method includes: an electrostatic latent image forming process in which an electrostatic latent image is formed on an electrostatic latent image bearer; a developing process in which the electrostatic latent image formed on the electrostatic latent image bearer is developed into a toner image with the above toner; a transfer process in which the toner image is transferred from the electrostatic latent image bearer onto a surface of a recording medium; and a fixing process in which the toner image is fixed on the surface of the recording medium.

In the developing device and the developing process, the above-described toner in accordance with some embodiments of the present invention is used. More preferably, a developer containing the above-described toner and other optional components, such as a carrier, is used to form the toner image.

Electrostatic Latent Image Bearer

The electrostatic latent image bearer is not limited in material, structure, and size. Specific examples of usable materials include, but are not limited to, inorganic photoconductors such as amorphous silicon and selenium, and organic photoconductors such as polysilane and phthalopolymethine. Among these materials, amorphous silicone is preferable for long operating life.

Electrostatic Latent Image Forming Device and Electrostatic Latent Image Forming Process The electrostatic latent image forming device has no limit so long as it can form an electrostatic latent image on the electrostatic latent image bearer. For example, the electrostatic latent image forming device may include a charger to uniformly charge a surface of the electrostatic latent image bearer and an irradiator to irradiate the surface of the electrostatic latent image bearer with light containing image information.

The electrostatic latent image forming process has no limit so long as an electrostatic latent image can be formed on the electrostatic latent image bearer. For example, the electrostatic latent image forming process may include charging a surface of the electrostatic latent image bearing member and irradiating the surface with light containing image information. The electrostatic latent image forming process can be performed by the electrostatic latent image forming device.

Charger and Charging Process

Specific examples of the charger include, but are not limited to, contact chargers equipped with a conductive or semiconductive roller, brush, film, or rubber blade, and non-contact chargers employing corona discharge such as corotron and scorotron.

The charging process may include applying a voltage to a surface of the electrostatic latent image bearer by the charger.

Irradiator and Irradiating Process

The irradiator has no limit so long as it can emit light containing image information to the surface of the electrostatic latent image bearer charged by the charger. Specific examples of the irradiator include, but are not limited to, various irradiators of radiation optical system type, rod lens array type, laser optical type, and liquid crystal shutter optical type.

Developing Device and Developing Process

The developing device has no limit so long as it can store a toner and develop the electrostatic latent image formed on the electrostatic latent image bearer into a visible image with the toner.

The developing process has no limit so long as the electrostatic latent image formed on the electrostatic latent image bearer can be developed into a visible image with a toner.

The developing process may be performed by the developing device.

The developing device may employ either a dry developing method or a wet developing method. The developing device may be either a single-color developing device or a multi-color developing device.

Preferably, the developing device includes a stirrer to frictionally stir and charge the toner, a magnetic field generator fixed inside the developing device, and a rotatable developer bearer to bear on its surface a developer containing the toner.

Other Devices and Other Processes

Examples of the other optional devices include, but are not limited to, a transfer device, a fixing device, a cleaner, a neutralizer, a recycler, and a controller.

Examples of the other optional processes include, but are not limited to, a transfer process, a fixing process, a cleaning process, a neutralization process, a recycle process, and a control process.

An image forming apparatus in accordance with some embodiments of the present invention is described below with reference to FIG. 5. A full-color image forming apparatus 100A illustrated in FIG. 5 includes a photoconductor drum 10 (hereinafter "photoconductor 10" or "electrostatic latent image bearer 10") serving as the electrostatic latent image bearer, a charging roller 20 serving as the charger, an irradiator 30 serving as the irradiator, a developing device 40 serving as the developing device, an intermediate transfer medium 50, a cleaner 60 equipped with a cleaning blade serving as the cleaner, and a neutralization lamp 70 serving as the neutralizer.

The intermediate transfer medium 50 is in the form of an endless belt and is stretched taut by three rollers 51 disposed inside the loop of the endless belt. The intermediate transfer medium 50 is movable in the direction indicated by arrow in FIG. 5. One or two of the three rollers 51 also function(s) as transfer bias roller(s) for applying a predetermined transfer bias (primary transfer bias) to the intermediate transfer medium 50. In the vicinity of the intermediate transfer medium 50, a cleaner 90 equipped with a cleaning blade is disposed. In the vicinity of the intermediate transfer medium 50, a transfer roller 80, serving as the transfer device, that applies a transfer bias to a transfer sheet 95, serving as a recording medium, for secondarily transferring a toner image thereon is disposed facing the intermediate transfer medium 50. Around the intermediate transfer medium 50, a corona charger 58 that gives charge to the toner image on the intermediate transfer medium 50 is disposed between the contact point of the intermediate transfer medium 50 with the photoconductor 10 and the contact point of the intermediate transfer medium 50 with the transfer sheet 95 relative to the direction of rotation of the intermediate transfer medium 50.

The developing device 40 includes a developing belt 41 serving as the developer bearer; and a black developing unit 45K, a yellow developing unit 45Y, a magenta developing unit 45M, and a cyan developing unit 45C each disposed around the developing belt 41. The black developing unit 45K includes a developer container 42K, a developer supply roller 43K, and a developing roller 44K. The yellow developing unit 45Y includes a developer container 42Y, a developer supply roller 43Y, and a developing roller 44Y. The magenta developing unit 45M includes a developer container 42M, a developer supply roller 43M, and a developing roller 44M. The cyan developing unit 45C includes a developer container 42C, a developer supply roller 43C, and a developing roller 44C. The developing belt 41 is in the form of an endless belt and stretched taut by multiple belt rollers. A part of the developing belt 41 is in contact with the photoconductor 10.

Figure 5:
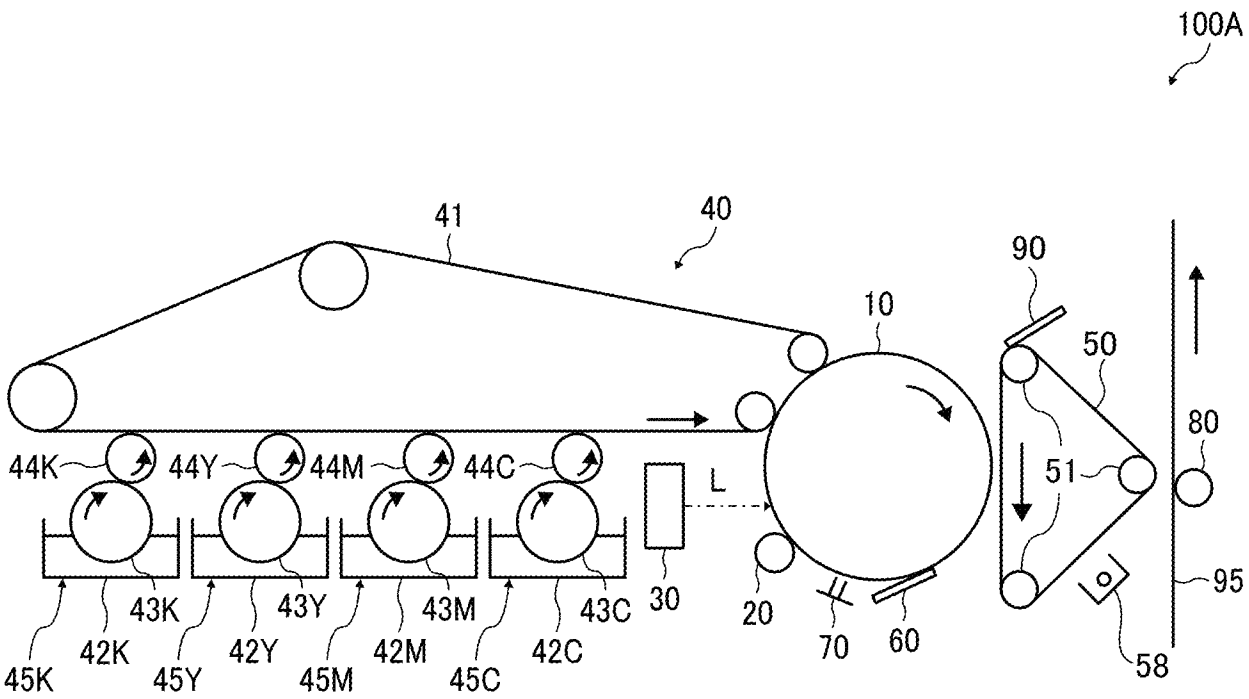
FIG. 5 is a schematic view of an image forming apparatus in accordance with some embodiments of the present invention.

In the image forming apparatus 100A illustrated in FIG. 5, the charging roller 20 uniformly charges the photoconductor drum 10. The irradiator 30 irradiates the photoconductor drum 10 with light L containing image information to form an electrostatic latent image thereon. The developing device 40 supplies toner to the electrostatic latent image formed on the photoconductor drum 10 to form a toner image. The toner image is primarily transferred onto the intermediate transfer medium 50 by a voltage applied from the roller 51 and secondarily transferred onto the transfer sheet 95. Thus, a transfer image is formed on the transfer sheet 95. Residual toner particles remaining on the photoconductor are removed by the cleaner 60. The charge of the photoconductor 10 is once eliminated by the neutralization lamp 70.

Figure 6:
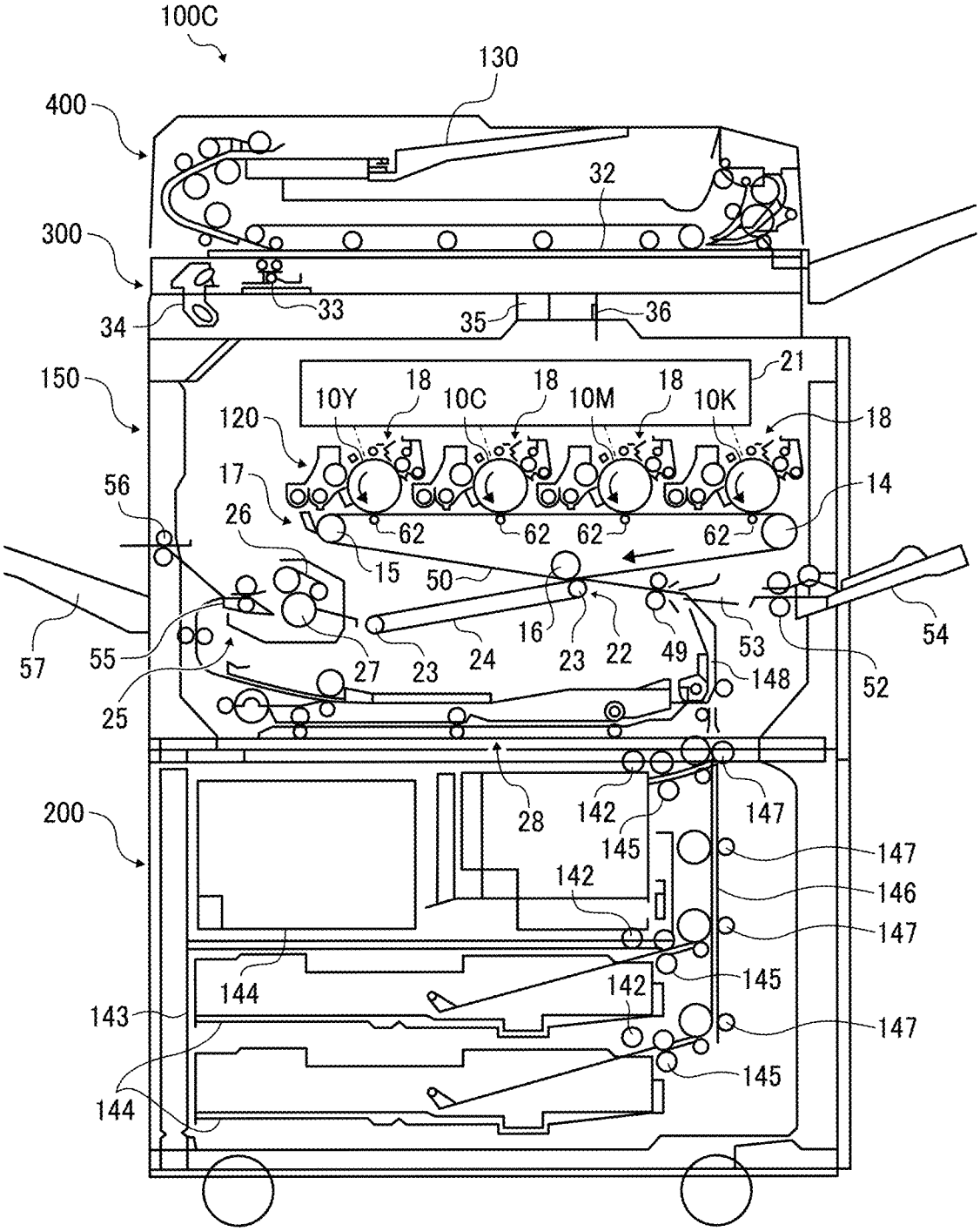
FIG. 6 is a schematic view of an image forming apparatus in accordance with some embodiments of the present invention.

FIG. 6 is a schematic view of another image forming apparatus in accordance with some embodiments of the present invention. An image forming apparatus 100C illustrated in FIG. 6 includes a copier main body 150, a sheet feed table 200, a scanner 300, and an automatic document feeder (ADF) 400.

In the central part of the copier main body 150, an intermediate transfer medium 50 in the form of an endless belt is disposed. The intermediate transfer medium 50 is stretched taut with support rollers 14, 15, and 16 and rotatable clockwise in FIG. 6. In the vicinity of the support roller 15, an intermediate transfer medium cleaner 17 for removing residual toner particles remaining on the intermediate transfer medium 50 is disposed. Four image forming units 18 for respectively forming yellow, cyan, magenta, and black images are arranged in tandem facing a part of the intermediate transfer medium 50 stretched between the support rollers 14 and 15 in the direction of conveyance of the intermediate transfer medium 50, thus forming a tandem developing device 120. In the vicinity of the tandem developing device 120, an irradiator 21 serving as the irradiator is disposed. On the opposite side of the tandem developing device 120 relative to the intermediate transfer medium 50, a secondary transfer device 22 is disposed. The secondary transfer device 22 includes a secondary transfer belt 24 in the form of an endless belt stretched taut with a pair of rollers 23. A transfer sheet conveyed on the secondary transfer belt 24 and the intermediate transfer medium 50 can contact with each other. In the vicinity of the secondary transfer device 22, a fixing device serving as the fixing device is disposed. The fixing device 25 includes a fixing belt 26 in the form of an endless belt and a pressing roller 27 pressed against the fixing belt 26.

In the vicinity of the secondary transfer device 22 and the fixing device 25, a sheet reversing device 28 is disposed for reversing the transfer sheet so that images can be formed on both surfaces of the transfer sheet.

A full-color image forming (color copying) operation performed using the tandem developing device 120 is described below. First, a document is set on a document table 130 of the automatic document feeder 400. Alternatively, a document is set on a contact glass 32 of the scanner 300 while the automatic document feeder 400 is lifted up, followed by holding down of the automatic document feeder 400.

As a start switch is pressed, in a case in which a document is set to the automatic document feeder 400, the scanner 300 starts driving after the document is moved onto the contact glass 32; and in a case in which a document is set on the contact glass 32, the scanner 300 immediately starts driving. A first traveling body 33 and a second traveling body 34 thereafter start traveling. The first traveling body 33 directs light emitted from a light source to the document. A mirror carried by the second traveling body 34 reflects light reflected from the document containing a color image toward a reading sensor 36 through an imaging lens 35. Thus, the document is read by the reading sensor 36 and converted into image information of yellow, magenta, and cyan.

The image information of yellow, cyan, magenta, and black are respectively transmitted to the respective image forming units 18 (i.e., yellow image forming device, cyan image forming device, magenta image forming device, and black image forming device) included in the tandem developing device 120. The image forming units 18 form respective toner images of yellow, cyan, magenta, and black. Each of the image forming units 18 (i.e., yellow image forming device, cyan image forming device, magenta image forming device, or black image forming device) in the tandem developing device 120 includes: an electrostatic latent image bearer 10 (i.e., electrostatic latent image bearers 10Y, 10C, 10M, or 10K); a charger to uniformly charge the electrostatic latent image bearer 10; an irradiator to irradiate the electrostatic latent image bearer 10 with light based on the color image information to form an electrostatic latent image thereon; a developing device to develop the electrostatic latent image with respective toner (i.e., yellow toner, cyan toner, magenta toner, or black toner) to form a toner image; a transfer charger 62 to transfer the toner image onto the intermediate transfer medium 50, a cleaner, and a neutralizer. Each image forming unit 18 forms a single-color toner image (i.e., yellow toner image, magenta toner image, cyan toner image, or black toner image) based on the image information of each color. The toner images of yellow, cyan, magenta, and black are primarily transferred from the respective electrostatic latent image bearers 10Y, 10C, 10M, and 10K in a sequential manner onto the intermediate transfer medium 50 that is rotated by the support rollers 14, 15, and 16. The toner images of yellow, cyan, magenta, and black are superimposed on one another on the intermediate transfer medium 50, thus forming a composite full-color toner image.

At the same time, in the sheet feed table 200, one of sheet feed rollers 142 starts rotating to feed recording sheets from one of sheet feed cassettes 144 in a sheet bank 143. One of separation rollers 145 separates the sheets one by one and feeds them to a sheet feed path 146. Feed rollers 147 feed each sheet to a sheet feed path 148 in the copier main body 150. The sheet is stopped by striking a registration roller 49. Alternatively, sheets may be fed from a manual feed tray 54. In this case, a separation roller 52 separates the sheets one by one and feeds it to a manual sheet feed path 53. The sheet is stopped by striking the registration roller 49. The registration roller 49 is generally grounded. Alternatively, the registration roller 49 may be applied with a bias for the purpose of removing paper powders from the sheet. The registration roller 49 starts rotating to feed the sheet to between the intermediate transfer medium 50 and a secondary transfer device 22 in synchronization with an entry of the composite full-color toner image formed on the intermediate transfer medium 50 thereto. The secondary transfer device 22 secondarily transfers the composite full-color toner image onto the sheet. Thus, the composite full-color image is formed on the sheet. After the composite full-color image is transferred, residual toner particles remaining on the intermediate transfer medium 50 are removed by the intermediate transfer medium cleaner 17.

The sheet having the composite full-color toner image thereon is fed from the secondary transfer device 22 to the fixing device 25. The fixing device 25 fixes the composite full-color toner image on the sheet by application of heat and pressure. A switch claw 55 switches sheet feed paths so that the sheet is ejected by an ejection roller 56 and stacked on a sheet ejection tray 57. Alternatively, the switch claw 55 may switch sheet feed paths so that the sheet is introduced into the sheet reversing device 28 and gets reversed. The sheet is then introduced to the transfer position again so that another image is recorded on the back side of the sheet. Thereafter, the sheet is ejected by the ejection roller 56 and stacked on the sheet ejection tray 57.

EXAMPLES

The present invention is described in detail with reference to the Examples but is not limited to the following Examples. "Parts" represents parts by mass and "% (percent)" represents percent by mass unless otherwise specified in the following description.

Preparation of Aqueous Phase

In a reaction vessel equipped with a stirrer and a thermometer, 683 parts of water, 16 parts of a sodium salt of sulfate of ethylene oxide adduct of methacrylic acid (ELEMINOL RS-30 available from Sanyo Chemical Industries, Ltd.), 83 parts of styrene, 83 parts of methacrylic acid, 110 parts of n-butyl acrylate, and 1 part of ammonium persulfate were contained and stirred at a revolution of 400 rpm for 15 minutes. The vessel contents were heated to 75° C. and allowed to react for 5 hours. After 30 parts of a 1% aqueous solution of ammonium persulfate was added to the vessel, the vessel contents were aged at 75° C. for 5 hours. Thus, a vinyl resin dispersion liquid was prepared. The volume average particle diameter of the vinyl resin dispersion liquid, measured by a laser diffraction particle size distribution analyzer LA-920 (available from Horiba, Ltd.), was 14 nm. The vinyl resin had an acid value of 45 mgKOH/g, a weight average molecular weight of 300,000, and a glass transition temperature of 60° C.

Next, 455 parts of water, 7 parts of the vinyl resin dispersion liquid, 17 parts of a 48.5% by mass aqueous solution of sodium dodecyl diphenyl ether disulfonate (ELEMINOL MON-7 available from Sanyo Chemical Industries, Ltd.), and 41 parts of ethyl acetate were stir-mixed. Thus, an aqueous phase in an amount of 520 parts was prepared.

Synthesis of Wax Dispersing Agent 1

In a reaction vessel equipped with a stirrer and a thermometer, 480 parts of xylene and 100 parts of a paraffin wax HNP-9 (available from Nippon Seiro Co., Ltd.) were contained and heated until they were dissolved. After the air in the vessel was replaced with nitrogen gas, the temperature was raised to 170° C. Next, a mixture liquid of 740 parts of styrene, 100 parts of acrylonitrile, 60 parts of butyl acrylate, 36 parts of di-t-butyl peroxyhexahydroterephthalate, and 100 parts of xylene was dropped in the vessel over a period of 3 hours, and the temperature was kept at 170° C. for 30 minutes. The solvent was thereafter removed. Thus, a wax dispersing agent 1 was prepared.

Preparation of Wax Dispersion Liquid W1

In a reaction vessel equipped with a stirrer and a thermometer, 150 parts of a paraffin wax HNP-9 (available from Nippon Seiro Co., Ltd.), 15 parts of the wax dispersing agent 1, and 335 parts of ethyl acetate were contained, heated to 80° C. while being stirred, and kept at 80° C. for 5 hours. The vessel contents were cooled to 30° C. over a period of 1 hour, and thereafter subjected to a dispersion treatment using a bead mill (ULTRAVISCOMILL available from Aimex Co., Ltd.) filled with 80% by volume of zirconia beads having a diameter of 0.5 mm at a liquid feeding speed of 1 kg/hour and a disc peripheral speed of 6 msec. This operation was repeated 3 times (3 passes). Thus, a wax dispersion liquid W1 was prepared. The particle diameter of the wax dispersion liquid W1, measured by an instrument LA-920 (available from HORIBA, Ltd.), was 350 nm. The wax dispersion liquid W1 was then diluted with a largely excessive amount of ethyl acetate and dried. The dried wax was observed with an electron microscope. As a result, it was confirmed that the wax was in a plate-like shape. (Wax solid content concentration was 30% and total solid content concentration was 33%.)

Preparation of Needle-Like Wax Dispersion Liquid

In a reaction vessel equipped with a stirrer and a thermometer, 150 parts of a paraffin wax HNP-9 (available from Nippon Seiro Co., Ltd.), 15 parts of the wax dispersing agent 1, and 335 parts of ethyl acetate were contained, heated to 80° C. while being stirred, and kept at 80° C. for 5 hours. The vessel contents were thereafter cooled to 30° C. over a period of 1 hour. The resulting crystallized product was observed with an optical microscope. As a result, it was confirmed that the crystallized product was a needle-like crystal having a size of about 100 μm to 1 mm. The resulting dispersion liquid was subjected to a dispersion treatment using a homogenizer (POLYTRON available from Kinematica AG) at a revolution of 10,000 rpm for 30 minutes. As a result, the needle-like crystal was ground to have a size of about 1 to 10 μm. Thus, a needle-like wax dispersion liquid 1 was prepared. (Wax solid content concentration was 30% and total solid content concentration was 33%.)

Synthesis of Amorphous Polyester R2

In a reaction vessel equipped with a cooling tube, a stirrer, and a nitrogen introducing tube, 222 parts of ethylene oxide 2-mol adduct of bisphenol A, 129 parts of propylene oxide 2-mol adduct of bisphenol A, 166 parts of isophthalic acid, and 0.5 parts of tetrabutoxy titanate were contained. The vessel contents were allowed to react at 230° C. for 8 hours under nitrogen gas flow while removing the produced water. Next, the vessel contents were allowed to react under reduced pressures of from 5 to 20 mmHg, cooled to 180° C. (normal pressure) at the time when the acid value became 2 mgKOH/g, and further allowed to react with 35 parts of trimellitic anhydride for 3 hours. Thus, an amorphous polyester polyester R2 was prepared. The amorphous polyester R2 had a weight average molecular weight of 8,000 and a glass transition temperature of 62° C.

Preparation of Oil Phase 1

In a vessel equipped with a thermometer and a stirrer, 100 parts of the amorphous polyester R2 was dissolved in 105 parts of ethyl acetate by stirring. Next, 20 parts of the wax dispersion liquid W1 and 20 parts of a small-particle-diameter aluminum paste pigment (2173YC available from Toyo Aluminium K.K., propyl acetate dispersion having a solid content of 50%) were added to the vessel. The vessel contents were mixed by a TK HOMOMIXER (available from Primix Corporation) at a revolution of 5,000 rpm for 1 hour while keeping the inner temperature at 20° C. in ice bath. The air was sprayed onto the liquid surface being stirred at room temperature. Thus, an oil phase 1 was obtained, the solid content concentration of which was adjusted to 50% by mass.

Example 1

In a vessel equipped with a stirrer and a thermometer, 550 parts of the aqueous phase was contained and kept at 20° C. in water bath. Next, 450 parts of the oil phase 1 kept at 20° C. was added to the vessel, and the vessel contents were mixed by a TK HOMOMIXER (available from PRIMIX Corporation) at a revolution of 13,000 rpm for 1 minute while keeping the temperature at 20° C., thus obtaining an emulsion slurry. As a result of optical microscope observation, the resulting oil droplets were in a flat shape. In a vessel equipped with a stirrer and a thermometer, the emulsion slurry was contained and the solvent was removed therefrom at 40° C. under reduced pressures, thus obtaining a slurry containing 80% of oil droplets on solid basis.

The slurry was mixed by a TK HOMOMIXER (available from PRIMIX Corporation) at a revolution of 8,000 rpm for 5 minutes while keeping the temperature at 40° C., thus applying a shearing stress to the slurry. As a result of optical microscope observation, the resulting oil droplets were in an ellipsoid-like shape. The solvent was further removed from the slurry at 40° C. under reduced pressures, thus obtaining a slurry containing 0% of volatile components of the organic solvent.

The slurry was thereafter cooled to room temperature and filtered under reduced pressures. Next, 200 parts of ion-exchange water was added to the filter cake and mixed by a THREE-ONE MOTOR (available from Shinto Scientific Co., Ltd.) at a revolution of 800 rpm for 5 minutes for re-slurry, followed by filtration. Next, 10 parts of a 1% by mass aqueous solution of sodium hydroxide and 190 parts of ion-exchange water were added to the filter cake for re-slurry, followed by filtration. Next, 10 parts of a 1% by mass aqueous solution of hydrochloric acid and 190 parts of ion-exchange water were added to the filter cake for re-slurry, followed by filtration. Next, 300 parts of ion-exchange water was added to the filter cake for re-slurry, followed by filtration. This operation was repeated twice.

The filter cake was dried by a circulating air dryer at 45° C. for 48 hours and sieved with a mesh having an opening of 75 μm. Thus, mother toner particles were prepared.

Next, 100 parts of the mother toner particles and 1 part of a hydrophobized silica HDK-2000 (available from Wacker Chemie AG) were mixed by a HENSCHEL MIXER (available from Mitsui Mining and Smelting Co., Ltd.) at a peripheral speed of 30 m/s for 30 seconds, followed by a pause for 1 minute. This operation was repeated 5 times. The mixture was sieved with a mesh having an opening of 35 μm. Thus, a toner of Example 1 was prepared.

Example 2

A toner was prepared in the same manner as in Example 1 except for the following conditions. After the solvent was removed from the emulsion slurry at 40° C. under reduced pressures to obtain a slurry containing 80% of oil droplets on solid basis, the treatment was performed at a temperature 10° C. higher than that in Example 1. Specifically, the resulting slurry was mixed by a TK HOMOMIXER (available from PRIMIX Corporation) at a revolution of 8,000 rpm for 10 minutes while keeping the temperature at 50° C., thus applying a shearing stress to the slurry.

As a result of optical microscope observation, the resulting oil droplets were in an ellipsoid-like or sphere-like shape.

The subsequent treatments were performed in the same manner as in Example 1, thus obtaining a toner of Example 2.

Example 3

A toner was prepared in the same manner as in Example 1 except for the following conditions. After the solvent was removed from the emulsion slurry at 40° C. under reduced pressures to obtain a slurry containing 80% of oil droplets on solid basis, the treatment was performed at a temperature 25° C. higher than that in Example 1. Specifically, the resulting slurry was mixed by a TK HOMOMIXER (available from PRIMIX Corporation) at a revolution of 8,000 rpm for 20 minutes while keeping the temperature at 65° C., thus applying a shearing stress to the slurry.

As a result of optical microscope observation, the resulting oil droplets were in a sphere-like shape.

The subsequent treatments were performed in the same manner as in Example 1, thus obtaining a toner of Example 3.

Preparation of Oil Phase 2

An oil phase containing plate-like wax particles in large amounts was prepared as follows.

In a vessel equipped with a thermometer and a stirrer, 100 parts of the amorphous polyester R2 was dissolved in 105 parts of ethyl acetate by stirring. Next, 40 parts of the wax dispersion liquid W1 and 20 parts of a small-particle-diameter aluminum paste pigment (2173YC available from Toyo Aluminium K.K., propyl acetate dispersion having a solid content of 50%) were added to the vessel. The vessel contents were mixed by a TK HOMOMIXER (available from Primix Corporation) at a revolution of 5,000 rpm for 1 hour while keeping the inner temperature at 20° C. in ice bath. The air was sprayed onto the liquid surface being stirred at room temperature. Thus, an oil phase 2 having a solid content concentration of 50% by mass was obtained.

Example 4

In a vessel equipped with a stirrer and a thermometer, 550 parts of the aqueous phase was contained and kept at 20° C. in water bath. Next, 450 parts of the oil phase 2 kept at 20° C. was added to the vessel, and the vessel contents were mixed by a TK HOMOMIXER (available from PRIMIX Corporation) at a revolution of 13,000 rpm for 1 minute while keeping the temperature at 20° C., thus obtaining an emulsion slurry. As a result of optical microscope observation, the resulting oil droplets were in a flat shape. In a vessel equipped with a stirrer and a thermometer, the emulsion slurry was contained and the solvent was removed therefrom at 40° C. under reduced pressures, thus obtaining a slurry containing 80% of oil droplets on solid basis.

The resulting slurry was mixed by a TK HOMOMIXER (available from PRIMIX Corporation) at a revolution of 8,000 rpm for 10 minutes while keeping the temperature at 50° C., thus applying a shearing stress to the slurry. As a result of optical microscope observation, the resulting oil droplets were in an ellipsoid-like or sphere-like shape. The solvent was further removed from the slurry at 40° C. under reduced pressures, thus obtaining a slurry containing 0% of volatile components of the organic solvent. As a result of TEM observation, plate-like wax particles having a size of 1 μm or less were interposed between plate-like aluminum pigment particles.

Preparation of Wax Dispersion Liquid W2

A dispersion liquid containing fine wax particles was prepared as follows.

In a reaction vessel equipped with a stirrer and a thermometer, 150 parts of a paraffin wax HNP-9 (available from Nippon Seiro Co., Ltd.), 15 parts of the wax dispersing agent 1, and 335 parts of ethyl acetate were contained, heated to 80° C. while being stirred, and kept at 80° C. for 5 hours. The vessel contents were cooled to 30° C. over a period of 1 hour, and thereafter subjected to a dispersion treatment using a bead mill (ULTRAVISCOMILL available from Aimex Co., Ltd.) filled with 80% by volume of zirconia beads having a diameter of 0.5 mm at a liquid feeding speed of 0.5 kg/hour and a disc peripheral speed of 10 m/sec. This operation was repeated 10 times (10 passes). Thus, a wax dispersion liquid W2 was prepared. The particle diameter of the wax dispersion liquid W2, measured by an instrument LA-920 (available from HORIBA, Ltd.), was 125 nm. The wax dispersion liquid W2 was then diluted with a largely excessive amount of ethyl acetate and dried. The dried wax was observed with an electron microscope. As a result, it was confirmed that the wax was in a sphere-like shape. (Wax solid content concentration was 30% and total solid content concentration was 33%.)

Preparation of Oil Phase 3

An oil phase containing fine wax particles was prepared as follows.

In a vessel equipped with a thermometer and a stirrer, 100 parts of the amorphous polyester R2 was dissolved in 105 parts of ethyl acetate by stirring. Next, 20 parts of the wax dispersion liquid W2 and 20 parts of a small-particle-diameter aluminum paste pigment (2173YC available from Toyo Aluminium K.K., propyl acetate dispersion having a solid content of 50%) were added to the vessel. The vessel contents were mixed by a TK HOMOMIXER (available from Primix Corporation) at a revolution of 5,000 rpm for 1 hour while keeping the inner temperature at 20° C. in ice bath. The air was sprayed onto the liquid surface being stirred at room temperature. Thus, an oil phase 3 having a solid content concentration of 50% by mass was obtained.

Example 5

The procedure in Example 2 was repeated except for replacing the oil phase 1 with the oil phase 3. Thus, a toner of Example 5 was prepared.

As a result of TEM observation, spherical wax particles having a size of about 100 to 200 nm were distributed in the toner particle, and just a part of them were interposed between plate-like aluminum pigment particles.

Example 6

An oil phase, an aqueous phase, and an emulsion slurry were prepared in the same manner as in Example 1 except for the following conditions. The process for applying a shearing stress for toner shape adjustment was not performed, and residual volatile components of the organic solvent, remaining even after the process of solvent removal at 40° C. under reduced pressures, were removed to obtain a slurry. The subsequent treatments were performed in the same manner as in Example 1, thus obtaining a toner. As a result of optical microscope observation, the resulting toner particles were in a flat disc-like shape.

Example 7

A toner was prepared in the same manner as in Example 1 except for replacing the aluminum pigment used in preparing the oil phase was replaced with another one having a middle particle diameter.

Specifically, In Example 7, a middle-particle-diameter aluminum pigment paste (2172YC available from Toyo Aluminium K.K., propyl acetate dispersion having a solid content of 50%) in an amount of 20 parts was used.

Example 8

A toner was prepared in the same manner as in Example 4 except for replacing the aluminum pigment used in preparing the oil phase was replaced with another one having a large particle diameter.

In Example 8, an oil phase containing plate-like wax particles in large amounts was prepared.

Specifically, the oil phase of Example 8 was comprised of 100 parts of the amorphous polyester R2, 105 parts of ethyl acetate, 40 parts of the wax dispersion liquid W1, and 20 parts of a large-particle-diameter aluminum pigment paste (TD200PA available from Toyo Aluminium K.K., propyl acetate dispersion having a solid content of 50%).

Synthesis of Crystalline Polyester R1

In a reaction vessel equipped with a cooling tube, a stirrer, and a nitrogen introducing tube, 202 parts of sebacic acid, 15 parts of adipic acid, 177 parts of 1,6-hexanediol, and 0.5 parts of tetrabutoxy titanate as a condensation catalyst were allowed to react at 180° C. for 8 hours under nitrogen gas flow while removing the produced water. After the temperature was gradually raised to 220° C., the reaction was continued for 4 hours under reduced pressures of from 5 to 20 mmHg under nitrogen gas flow while removing the produced water and 1,6-hexanediol, until the weight average molecular weight of the reaction product reached about 12,000. Thus, a crystalline polyester R1 was prepared. The crystalline polyester R1 had a weight average molecular weight of 12,000 and a melting point of 60° C.

Preparation of Needle-Like Crystalline Polyester Dispersion Liquid

In a reaction vessel equipped with a stirrer and a thermometer, 150 parts of the crystalline polyester R1 and 335 parts of ethyl acetate were contained, heated to 80° C. while being stirred, and kept at 80° C. for 5 hours, to dissolve the crystalline polyester R1 in ethyl acetate. The vessel was rapidly cooled by being dipped in methanol bath cooled with dry ice. Thus, a crystalline polyester dispersion liquid was prepared. The crystallized product obtained by cooling the crystalline polyester dispersion liquid at −20° C. for 1 hour was observed with an optical microscope. As a result, it was confirmed that the crystallized product was a needle-like crystal having a size of about 1 to 15 μm.

Preparation of Oil Phase 4

In a vessel equipped with a thermometer and a stirrer, 100 parts of the amorphous polyester R2 was dissolved in 105 parts of ethyl acetate by stirring. Next, 20 parts of the wax dispersion liquid W1, 10 parts of the needle-like wax dispersion liquid 1, 10 parts of the needle-like crystalline polyester dispersion liquid, and 20 parts of a large-particle-diameter aluminum pigment paste (TD200PA available from Toyo Aluminium K.K., propyl acetate dispersion having a solid content of 50%) were added to the vessel. The vessel contents were mixed by a TK HOMOMIXER (available from Primix Corporation) at a revolution of 5,000 rpm for 1 hour while keeping the inner temperature at 20° C. in ice bath. The amount of the solvent was adjusted by distillation. Thus, an oil phase 4 having a solid content concentration of 50% by mass was obtained.

Example 9

In a vessel equipped with a stirrer and a thermometer, 550 parts of the aqueous phase was contained and kept at 20° C. in water bath. Next, 450 parts of the oil phase 4 kept at 20° C. was added to the vessel, and the vessel contents were mixed by a TK HOMOMIXER (available from PRIMIX Corporation) at a revolution of 13,000 rpm for 1 minute while keeping the temperature at 20° C., thus obtaining an emulsion slurry. As a result of optical microscope observation, the resulting oil droplets were in a flat shape.

In a vessel equipped with a decompressor, a stirrer, and a thermometer, the emulsion slurry was contained and the solvent was removed therefrom at 40° C. under reduced pressures, thus obtaining a slurry containing 80% of oil droplets on solid basis.

The resulting slurry was mixed by a TK HOMOMIXER (available from PRIMIX Corporation) at a revolution of 10,000 rpm for 30 minutes while keeping the temperature at 65° C., thus applying a shearing stress to the slurry. As a result of optical microscope observation, the resulting oil droplets were in a sphere-like shape.

The solvent was further removed from the slurry at 40° C. under reduced pressures, thus obtaining a slurry containing 0% of volatile components of the organic solvent. The subsequent treatments were performed in the same manner as in Example 1, thus obtaining a toner of Example 9.

Preparation of Oil Phase 5

In a vessel equipped with a thermometer and a stirrer, 100 parts of the amorphous polyester R2 was dissolved in 105 parts of ethyl acetate by stirring. Next, 15 parts of the wax dispersion liquid W1, 6 parts of the needle-like wax dispersion liquid 1, 20 parts of a large-particle-diameter aluminum pigment paste (TD120T available from Toyo Aluminium K.K., toluene dispersion having a solid content of 50%), and 1 part of an organically-modified layered inorganic compound (TIXOGEL (registered trademark) MP 250 available from BYK Additives & Instruments) were added to the vessel. The vessel contents were mixed by a TK HOMOMIXER (available from Primix Corporation) at a revolution of 5,000 rpm for 1 hour while keeping the inner temperature at 20° C. in ice bath. Thus, an oil phase 5 having a solid content concentration of 50% by mass was obtained.

Example 10

In a vessel equipped with a stirrer and a thermometer, 550 parts of the aqueous phase was contained and kept at 20° C. in water bath. Next, 450 parts of the oil phase 5 kept at 20° C. was added to the vessel, and the vessel contents were mixed by a TK HOMOMIXER (available from PRIMIX Corporation) at a revolution of 13,000 rpm for 1 minute while keeping the temperature at 20° C., thus obtaining an emulsion slurry. As a result of optical microscope observation, the resulting oil droplets were in a spherical shape.

In a vessel equipped with a decompressor, a stirrer, and a thermometer, the emulsion slurry was contained and the solvent was removed therefrom at 40° C. under reduced pressures, thus obtaining a slurry containing 0% of oil droplets on solid basis. The subsequent treatments were performed in the same manner as in Example 1, thus obtaining a toner of Example 10.

It was presumed that the organically-modified inorganic compound particles were gathered into a layer on the surface of the oil droplet and the toner thereby remained in a non-flat shape.

Synthesis of Prepolymer

In a reaction vessel equipped with a cooling tube, a stirrer, and a nitrogen introducing tube, 682 parts of ethylene oxide 2-mol adduct of bisphenol A, 81 parts of propylene oxide 2-mol adduct of bisphenol A, 283 parts of terephthalic acid, 22 parts of trimellitic anhydride, and 2 parts of dibutyltin oxide were contained and allowed to react at 230° C. for 8 hours under normal pressure. The reaction was continued under reduced pressures of from 10 to 15 mmHg for 5 hours, thus obtaining an intermediate polyester. The intermediate polyester had a number average molecular weight (Mn) of 2,100, a weight average molecular weight (Mw) of 9,600, a glass transition temperature (Tg) of 55° C., an acid value of 0.5, and a hydroxyl value of 49.

In a reaction vessel equipped with a cooling tube, a stirrer, and a nitrogen introducing tube, 411 parts of the intermediate polyester, 89 parts of isophorone diisocyanate, and 500 parts of ethyl acetate were contained and allowed to react at 100° C. for 5 hours, thus synthesizing a prepolymer (i.e., polymer reactive with a compound having an active hydrogen group). The content rate of free isocyanate in the prepolymer was 1.60% by mass. The solid content concentration in the prepolymer was 50% by mass (when measured at 150° C. after leaving the prepolymer to stand for 45 minutes).

Preparation of Oil Phase 6

In a vessel equipped with a thermometer and a stirrer, 100 parts of the amorphous polyester R2 was dissolved in 105 parts of ethyl acetate by stirring. Next, 18 parts of the wax dispersion liquid W1, 7 parts of the needle-like wax dispersion liquid 1, 22 parts of a large-particle-diameter aluminum pigment paste (TD120T available from Toyo Aluminium K.K., toluene dispersion having a solid content of 50%) were added to the vessel. The vessel contents were mixed by a TK HOMOMIXER (available from Primix Corporation) at a revolution of 5,000 rpm for 1 hour while keeping the inner temperature at 20° C. in ice bath. Next, 20 parts of the prepolymer solution was added thereto and stirred and homogenized by a THREE-ONE MOTOR at a revolution of 600 rpm at 20° C. for 10 minutes. Thus, an oil phase 6 having a solid content concentration of 50% by mass was prepared.

Example 11

First, 455 parts of water, 7 parts of the vinyl resin dispersion liquid, 17 parts of a 48.5% by mass aqueous solution of sodium dodecyl diphenyl ether disulfonate (ELEMINOL MON-7 available from Sanyo Chemical Industries, Ltd.), and 41 parts of ethyl acetate were stir-mixed. Thus, an aqueous phase was prepared.

Further, 0.2 parts of hexamethylenediamine was added to the aqueous phase.

In a vessel equipped with a stirrer and a thermometer, 550 parts of the aqueous phase was contained and kept at 20° C. in water bath. Next, 450 parts of the oil phase 6 kept at 20° C. was added to the vessel, and the vessel contents were mixed by a TK HOMOMIXER (available from PRIMIX Corporation) at a revolution of 13,000 rpm for 1 minute while keeping the temperature at 20° C., thus obtaining an emulsion slurry. As a result of optical microscope observation, the resulting oil droplets were in a spherical shape.

In a vessel equipped with a decompressor, a stirrer, and a thermometer, the emulsion slurry was contained and the solvent was removed therefrom at 40° C. under reduced pressures, thus obtaining a slurry containing 0% of oil droplets on solid basis. The subsequent treatments were performed in the same manner as in Example 1, thus obtaining a toner of Example 11. It was presumed that, at the time of emulsification and formation of oil droplets, a polyurea layer comprising the reaction product of the prepolymer with the amine compound was formed on the surface of the oil droplet, and the toner thereby remained in a non-flat shape.

Comparative Example 1

A toner was prepared by an emulsion aggregation method as described below.

Preparation of Resin Fine Particle Dispersion Liquid

In a flask, 100 parts of the amorphous polyester R2 was dissolved in 100 parts of methyl ethyl ketone by stirring with a THREE-ONE MOTOR at a revolution of 600 rpm at 20° C. Further, 7 parts of ammonia water (28% by mass) was added to the flask and homogenized by stirring. Next, 200 parts of ion-exchange water was gradually added to the flask using a dropping funnel over a period of 1 hour. It was confirmed that the liquid had once become clouded and thickened but the viscosity had reduced with continuous dropping of ion-exchange water. Therefore, it was presumed that the resin solution had underwent phase-inversion.

The resulting resin dispersion liquid was thereafter subjected to pressure reduction at 40° C. so that the solvent was removed therefrom. Thus, a resin fine particle dispersion liquid 1 was prepared. The resin fine particles contained in the resin fine particle dispersion (having a resin fine particle concentration of 33%) had a volume average particle diameter of 80 nm when measured by a MICROTRAC UPA (available from Nikkiso Co., Ltd.).

Preparation of Wax Dispersion Liquid W2

In a vessel equipped with a stirrer and a thermometer, 150 parts of a paraffin wax HNP-9 (available from Nippon Seiro Co., Ltd.), 3 parts of sodium dodecylbenzene sulfonate, and 450 parts of ion-exchange water were contained. The vessel contents were stirred at 80° C. and subjected to a dispersion treatment using a bead mill (ULTRAVISCOMILL available from Aimex Co., Ltd.) filled with 80% by volume of zirconia beads having a diameter of 0.5 mm at a liquid feeding speed of 1 kg/hour and a disc peripheral speed of 6 m/sec. This operation was repeated 3 times (3 passes). Thus, a wax dispersion liquid W2 was prepared. After being cooled to 20° C., the wax dispersion liquid W2 was subjected to a measurement of particle diameter by an instrument MICROTRAC UPA (available from Nikkiso Co., Ltd.). As a result, the particle diameter was 220 nm (the solid content concentration of the wax was 25%).

Preparation of Emulsion Aggregation Toner

First, 300 parts of the resin fine particle dispersion liquid 1, 10 parts of the wax dispersion liquid W2, 10 parts of an aluminum pigment powder (1200M available from Toyo Aluminium K.K), and 200 parts of ion-exchange water were contained in a vessel. The vessel contents were mixed by a TK HOMOMIXER (available from Primix Corporation) at a revolution of 5,000 rpm for 1 hour while keeping the inner temperature at 20° C. in ice bath.

The vessel contents were stirred by a THREE-ONE MOTOR equipped with a paddle stirring blade at a revolution or 300 rpm and a 10% aqueous solution of aluminum chloride was dropped therein, while confirming formation of aggregated particles with an optical microscope. At the same time, the pH of the system was maintained at 3 to 4 by using hydrochloric acid. After confirmation of formation of aggregated particles, the inner temperature was raised to 65° C. and maintained for 1 hour for sintering particles. The resulting aggregated particles were in a flat shape, and the volume average particle diameter (D4) thereof was 13.5 μm when measured by a MULTISIZER III available from Beckman Coulter, Inc.

After the series of filtration, re-slurry, and water washing was repeated for 5 times and when the conductivity of the slurry became 50 μS/cm, the filter cake was dried by a circulating air dryer at 45° C. for 48 hours and sieved with a mesh having an opening of 75 μm. Thus, mother toner particles were prepared.

Next, 100 parts of the mother toner particles and 1 part of a hydrophobized silica HDK-2000 (available from Wacker Chemie AG) were mixed by a HENSCHEL MIXER (available from Mitsui Mining and Smelting Co., Ltd.) at a peripheral speed of 30 m/s for 30 seconds, followed by a pause for 1 minute. This operation was repeated 5 times. The mixture was sieved with a mesh having an opening of 35 μm. Thus, a toner of Comparative Example 1 was prepared. The resulting toner particles were in a flat shape, and the volume average particle diameter (D4) thereof was 12.5 μm when measured by a MULTISIZER III available from Beckman Coulter, Inc.

Comparative Example 2

A toner was prepared by an emulsion aggregation method while adjusting the distance between pigment particles by increasing the amount of wax.

Specifically, the amount of the wax dispersion liquid was increased from that in Comparative Example 1 as follows: 300 parts of the resin fine particle dispersion liquid 1, 30 parts of the wax dispersion liquid W2, 10 parts of an aluminum pigment powder (1200M available from Toyo Aluminium K.K), and 200 parts of ion-exchange water were contained in a vessel. The vessel contents were mixed by a TK HOMOMIXER (available from Primix Corporation) at a revolution of 5,000 rpm for 1 hour while keeping the inner temperature at 20° C. in ice bath.

The subsequent treatments were performed in the same manner as in Comparative Example 1, thus obtaining a toner of Comparative Example 2.

Comparative Example 3

A spherical toner having a circularity outside the above-specified range was prepared as follows.

Specifically, the toner was prepared in the same manner as in Example 1 except for the following conditions. After the solvent was removed from the emulsion slurry at 40° C. under reduced pressures to obtain a slurry containing 80% of oil droplets on solid basis, the treatment was performed at a temperature 40° C. higher than that in Example 1. More specifically, the resulting slurry was mixed by a TK HOMOMIXER (available from PRIMIX Corporation) at a revolution of 10,000 rpm for 60 minutes while keeping the temperature at 80° C., thus applying a shearing stress to the slurry.

As a result of optical microscope observation, the resulting oil droplets were in a true-sphere-like shape.

The subsequent treatments were performed in the same manner as in Example 1, thus obtaining a toner of Comparative Example 3.

Comparative Example 4

A toner was prepared by an emulsion aggregation method by previously aggregating aluminum pigment particles to prepare stack pigment particles.

Specifically, 10 parts of an aluminum pigment powder (1200M available from Toyo Aluminium K.K), 100 parts of ion-exchange water, and 1 part of sodium dodecylbenzene sulfonate were contained in a vessel. The vessel contents were mixed by a TK HOMOMIXER (available from Primix Corporation) at a revolution of 5,000 rpm for 1 hour while keeping the inner temperature at 20° C. in ice bath. Thus, an aqueous dispersion liquid 1 of aluminum pigment was prepared.

Next, 10 parts of a 1% calcium chloride solution was gradually dropped in the vessel to cause aggregation of the aluminum pigment particles. As a result of optical microscope observation, the aluminum pigment particles were aggregated in such a manner that planar portions thereof were stacked on each other.

Next, 300 parts of the resin fine particle dispersion liquid 1, 10 parts of the wax dispersion liquid W2, 111 parts of the aqueous dispersion liquid 1 of aluminum pigment (1200M available from Toyo Aluminium K.K), and 100 parts of ion-exchange water were mixed by a TK HOMOMIXER (available from Primix Corporation) at a revolution of 5,000 rpm for 1 hour while keeping the inner temperature at 20° C. in ice bath, so that the aggregated aluminum pigment particles were redispersed.

The mixture was stirred by a THREE-ONE MOTOR equipped with a paddle stirring blade at a revolution or 300 rpm and a 10% aqueous solution of aluminum chloride was dropped therein, while confirming formation of aggregated particles with an optical microscope. At the same time, the pH of the system was maintained at 3 to 4 by using hydrochloric acid. After confirmation of formation of aggregated particles, the inner temperature was raised to 80° C. and maintained for 3 hours for sintering particles. The resulting aggregated particles were in a flat shape, and the volume average particle diameter (D4) thereof was 12.5 μm when measured by a MULTISIZER III available from Beckman Coulter, Inc.

After the series of filtration, re-slurry, and water washing was repeated for 5 times and when the conductivity of the slurry became 50 gS/cm, the filter cake was dried by a circulating air dryer at 45° C. for 48 hours and sieved with a mesh having an opening of 75 μm. Thus, mother toner particles were prepared.

Next, 100 parts of the mother toner particles and 1 part of a hydrophobized silica HDK-2000 (available from Wacker Chemie AG) were mixed by a HENSCHEL MIXER (available from Mitsui Mining and Smelting Co., Ltd.) at a peripheral speed of 30 m/s for 30 seconds, followed by a pause for 1 minute. This operation was repeated 5 times. The mixture was sieved with a mesh having an opening of 35 μm. Thus, a toner of Comparative Example 4 was prepared. The resulting toner particles were in a flat shape, and the volume average particle diameter (D4) thereof was 11.3 μm when measured by a MULTISIZER III available from Beckman Coulter, Inc.

Comparative Example 5

A toner was prepared by dispersing and grinding aluminum pigment particles.

In a sealed vessel, 20 parts of the amorphous polyester R2 was dissolved in 100 parts of ethyl acetate by stirring.

Next, 20 parts of a small-particle-diameter aluminum paste pigment (2173YC available from Toyo Aluminium K.K., propyl acetate dispersion having a solid content of 50%) and 500 parts of zirconia beads having a diameter of 3 mm were contained in the vessel, and a dispersion treatment was performed using a ROCKING MILL (available from SEIWA GIKEN K.K.) at a frequency of 60 Hz for 4 hours. After separating the zirconia beads with a mesh, an aluminum pigment ethyl acetate dispersion liquid 1 was prepared. As a result of optical microscope observation, it was confirmed that the aluminum pigment particles in the dispersion liquid had been ground into small-size plate-like particles having a size of about 1 to 5 μm.

In a vessel equipped with a thermometer and a stirrer, 80 parts of the amorphous polyester R2 was dissolved in 140 parts of the aluminum pigment ethyl acetate dispersion liquid 1 by stirring. Next, 20 parts of the wax dispersion liquid W1 was added to the vessel. The vessel contents were mixed by a TK HOMOMIXER (available from Primix Corporation) at a revolution of 5,000 rpm for 1 hour while keeping the inner temperature at 20° C. in ice bath. The air was sprayed onto the liquid surface being stirred at room temperature. Thus, a comparative oil phase 1 having a solid content concentration of 50% by mass was obtained.

The subsequent procedures for preparing toner were performed in the same manner as in Example 1, thus obtaining a toner of Comparative Example 5.

Comparative Example 6

A toner was prepared by using a small-particle-diameter aluminum pigment.

Preparation of Oil Phase

In a vessel equipped with a thermometer and a stirrer, 100 parts of the amorphous polyester R2 was dissolved in 105 parts of ethyl acetate by stirring. Next, 20 parts of the wax dispersion liquid W1 and 20 parts of an aluminum paste pigment (0670TS available from Toyo Aluminium K.K., toluene dispersion having a solid content of 50%) having an average particle diameter of 4 μm were added to the vessel. The vessel contents were mixed by a TK HOMOMIXER (available from Primix Corporation) at a revolution of 5,000 rpm for 1 hour while keeping the inner temperature at 20° C. in ice bath. The air was sprayed onto the liquid surface being stirred at room temperature. Thus, a comparative oil phase 2 was obtained, the solid content concentration of which was adjusted to 50% by mass.

The subsequent procedures for preparing toner were performed in the same manner as in Example 1, thus obtaining a toner of Comparative Example 6.

Toner Evaluation Methods

Evaluation of Image Quality (Thin-line Reproducibility)

Each toner was set in an image forming apparatus IMAGIO NEO C600 PRO (available from Ricoh Co., Ltd.) to form a 400-dpi standard line chart image on a coated paper sheet (POD GLOSS COAT PAPER available from Oji Paper Co., Ltd.).

A thin-line portion in the output image was compared with that in the original document image and reproducibility was ranked based on the following criteria.

Rank 1: Parallel thin lines were collapsed and unseparated from each other.

Rank 2: Part of thin lines was separated from each other but most of them were collapsed.

Rank 3: Thin lines were separated from each other but partially thickened.

Rank 4: Thin lines were separated from each other and thickened very little.

Rank 5: The original document was reproduced.

Toner with an image quality rank of 2 or less is not practically usable. The toner in accordance with some embodiments of the present invention is capable of forming an image with satisfactory image quality because toner particles having a circularity of greater than 0.985 are excluded (see the results of Comparative Example 3 described below).

Evaluation of Glittering Property

Each toner was set in an image forming apparatus IMAGIO NEO C600 PRO (available from Ricoh Co., Ltd.) to form a solid image having a toner deposition amount of 0.50±0.10 mg/cm$^2$ and a size of 3 cm×8 cm on a coated paper sheet (POD GLOSS COAT PAPER available from Oji Paper Co., Ltd.).

The solid image was formed on the sheet at a position 3.0 cm away from the leading edge in the sheet feeding direction. Image samples were formed on respective sheets at respective temperatures of the fixing belt ranging from 130° C. to 180° C. at an interval of 10° C.

The degree of reflection of each image sample at the angle at which the reflected light became the highest under ordinary lighting in the office room were evaluated into 5 ranks as follows. Among the image samples formed at different temperatures of the fixing belt, the one with the highest evaluation was used as a representative sample.

Rank 1: Reflectivity was the same level as that of coated paper.

Rank 2: The amount of reflected light was changed little even when the angle was changed.

Rank 3: As the angle was changed, there was a region where the amount of reflected light was increased in one direction.

Rank 4: As the angle was changed, there was a large reflective region in one direction.

Rank 5: As the angle was changed, there was a very large reflective region in one direction.

Evaluation of Electrical Property Before and After Deterioration

Deteriorating Method

A 100-mL vial was charged with 50 g of a carrier for two-component developer exclusive for IMAGIO NEO C600 PRO (available from Ricoh Co., Ltd.) and 10 g of each toner. The vial was set to a ROCKING MILL RM-05 (available from SEIWA GIKEN K.K.) and agitated for 3 hours at a vibration velocity of 40 Hz.

The resulting developer was separated into toner and carrier using a sieve having an opening of 30 μm.

Measurement of Electrical Resistivity

The common logarithm (Log R) of volume resistivity (R) of the toner was measured as follows. First, 3 g of the toner was molded into a pellet having a diameter of 40 mm and a thickness of about 2 mm using a presser BRE-32 (available from MAEKAWA TESTING MACHINE MFG. Co., Ltd., with a load of 6 MPa and a pressing time of 1 minute).

The pellet was set to electrodes for solid (SE-70 product of Ando Electric Co., Ltd.) and an alternating current of 1 kHz was applied to between the electrodes. At this time, Log R was measured by an alternating-current-bridge measuring instrument composed of a dielectric loss measuring instrument TR-10C, an oscillator WBG-9, and an equilibrium point detector BDA-9 (all products of Ando Electric Co., Ltd.).

This measurement was performed before and after the toner had been deteriorated.

The toners of Examples 1 to 11 and Comparative Examples 1 to 6 were each subjected to the measurement of circularity of the toner; the average thickness D, maximum length L, maximum width W, and average distance H of plate-like pigment particles; and the rate of toner particles satisfying the formula: deviation angle θ>20°. Results are presented in Table 1.

In addition, the toners of Examples 1 to 11 and Comparative Examples 1 to 6 were each subjected to the above-described evaluations of image quality, glittering property, and electrical property (resistivity). Results are presented in Table 2.

TABLE 1

| No | Circularity | Average Thickness D (μm) | Maximum Length L (μm) | Maximum Width W (μm) | Average Distance H (μm) | Rate of Toner Particles Satisfying θ ≥20° (number %) |
|---|---|---|---|---|---|---|
| Example 1 | 0.960 | 0.85 | 5.3 | 3.5 | 0.7 | 35 |
| Example 2 | 0.975 | 0.88 | 6.8 | 4.3 | 0.6 | 32 |
| Example 3 | 0.983 | 0.83 | 7.7 | 3.8 | 0.8 | 38 |
| Example 4 | 0.968 | 0.82 | 6.5 | 5.2 | 1.2 | 45 |
| Example 5 | 0.972 | 0.80 | 5.5 | 4.6 | 0.4 | 36 |
| Example 6 | 0.951 | 0.92 | 6.8 | 3.8 | 0.6 | 25 |
| Example 7 | 0.958 | 0.53 | 9.5 | 5.8 | 0.8 | 42 |
| Example 8 | 0.972 | 0.43 | 10.3 | 6.8 | 1.3 | 44 |
| Example 9 | 0.980 | 0.65 | 9.6 | 7.2 | 1.2 | 56 |
| Example 10 | 0.979 | 0.88 | 8.2 | 6.3 | 1.0 | 68 |
| Example 11 | 0.982 | 0.75 | 8.3 | 8.8 | 2.1 | 86 |
| Comparative Example 1 | 0.910 | 0.86 | 6.3 | 3.5 | 0.2 | 5 |
| Comparative Example 2 | 0.920 | 0.95 | 5.5 | 4.3 | 0.5 | 21 |
| Comparative Example 3 | 0.990 | 0.75 | 6.8 | 3.3 | 0.6 | 25 |
| Comparative Example 4 | 0.953 | 1.35 | 7.2 | 5.3 | 0.8 | 33 |
| Comparative Example 5 | 0.955 | 0.75 | 4.3 | 4.4 | 1.0 | 40 |
| Comparative Example 6 | 0.950 | 0.85 | 5.5 | 2.5 | 0.9 | 36 |

TABLE 2

| No | Image Quality Rank | Glittering Property Rank | Resistivity (LogΩcm) | Resistivity after Deterioration (LogΩcm) |
|---|---|---|---|---|
| Example 1 | 3 | 4 | 10.60 | 10.50 |
| Example 2 | 4 | 3 | 10.80 | 10.70 |
| Example 3 | 5 | 3 | 10.90 | 10.85 |
| Example 4 | 4 | 3 | 11.00 | 10.90 |
| Example 5 | 4 | 3 | 10.50 | 10.45 |
| Example 6 | 3 | 3 | 10.45 | 10.40 |
| Example 7 | 4 | 4 | 10.75 | 10.65 |
| Example 8 | 4 | 4 | 11.10 | 10.80 |
| Example 9 | 5 | 4 | 11.20 | 11.00 |
| Example 10 | 5 | 5 | 11.10 | 11.10 |
| Example 11 | 5 | 5 | 11.30 | 11.30 |
| Comparative Example 1 | 1 | 2 | 9.80 | 9.20 |
| Comparative Example 2 | 2 | 2 | 10.25 | 9.90 |
| Comparative Example 3 | 2 | 3 | 10.45 | 10.30 |
| Comparative Example 4 | 2 | 1 | 10.20 | 10.10 |
| Comparative Example 5 | 3 | 2 | 10.40 | 10.20 |
| Comparative Example 6 | 3 | 2 | 10.10 | 10.00 |

It is clear from the above Examples that the toners in accordance with some embodiments of the present invention is capable of forming a high-definition high-quality image with glittering property and of preventing the occurrence of electrical resistivity decrease to prevent deterioration of electrical and charge properties.

When a toner containing a glittering pigment is prepared by an emulsion polymerization method (as disclosed in JP-5365648-B (corresponding to JP-2012-32765-A) or JP-2016-139053-A, for example), the toner does not exhibit a circularity within the above-specified range, as shown in Comparative Examples 1 and 2. This is because the shape of the toner is flattened due to the flat shape of the glittering pigment particles. In Comparative Examples 1 and 2, the evaluation results for image quality and electrical property before and after deterioration are poor. When a toner containing a glittering pigment is prepared by an emulsion polymerization method, the shape of the toner can be made spherical as the glittering pigment particles are previously subjected to an aggregating treatment so that the glittering pigment particles are stacked on each other to be thick. In this case, however, the electrical resistivity of the toner decreases due to the stacking of the pigment particles, which results in poor evaluation results in electrical property before and after deterioration, as shown in Comparative Example 4.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A toner comprising:

toner particles each comprising:

a binder resin; and pigment particles having a plate shape, wherein, in a cross-section of the toner, the pigment particles having a plate shape have an average thickness D of 1.0 μm or less and a maximum length L of 5.0 μm or more, wherein, in a fixed toner image formed with the toner, the pigment particles having a plate shape have a maximum width W of 3.0 μm or more, wherein the toner has a circularity of from 0.950 to 0.985.

2. The toner of claim 1, wherein, in the cross-section of the toner, an average distance H between the pigment particles having a plate shape adjacent to each other is 0.5 μm or more.

3. The toner of claim 1, wherein, in the cross-section of the toner, 30% by number or more of the toner particles each have a deviation angle θ of 20 degrees or more, where the deviation angle θ is an angle formed between a first one of the pigment particles having a plate shape, which has a longest length in one toner particle, and a second one of the pigment particles having a plate shape, which forms a largest deviation angle with the first one in the one toner particle.

4. The toner of claim 1, wherein the toner particles each further comprise a substance, which comprises at least one of a wax and a crystalline resin.

5. The toner of claim 4, wherein the substance has a needle shape or a plate shape.

6. A toner storage unit comprising:

a container; and the toner of claim 1 contained in the container.

7. An image forming apparatus comprising:

an electrostatic latent image bearer;

an electrostatic latent image forming device configured to form an electrostatic latent image on the electrostatic latent image bearer;

a developing device containing the toner of claim 1, configured to develop the electrostatic latent image on the electrostatic latent image bearer into a toner image with the toner;

a transfer device configured to transfer the toner image from the electrostatic latent image bearer onto a surface of a recording medium; and a fixing device configured to fix the toner image on the surface of the recording medium.

* * * * *